US010041420B2

(12) United States Patent
Feiner et al.

(10) Patent No.: US 10,041,420 B2
(45) Date of Patent: Aug. 7, 2018

(54) VALVE ASSEMBLY AND VALVE SYSTEM INCLUDING SAME

(71) Applicant: BORGWARNER INC., Auburn Hills, MI (US)

(72) Inventors: Aaron Feiner, Oxford, MI (US); Robert Keefover, Lake Orion, MI (US); Brenda L. Horn, Leonard, MI (US); Petr Malik, Rochester Hills, MI (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 15/252,448

(22) Filed: Aug. 31, 2016

(65) Prior Publication Data

US 2018/0058342 A1 Mar. 1, 2018

(51) Int. Cl.
*F02D 9/10* (2006.01)

(52) U.S. Cl.
CPC ..... *F02D 9/1045* (2013.01); *F02D 9/106* (2013.01); *F02D 9/108* (2013.01)

(58) Field of Classification Search
CPC ..... F02D 9/1065; F02D 2200/0404; F02D 9/1035; F02D 2009/0269; F02D 31/004
See application file for complete search history.

(56) References Cited

U.S. PATENT DOCUMENTS 5,624,100 A 4/1997 Bolte et al.
6,945,228 B2 * 9/2005 Saito ..... F02D 9/1065 123/361
7,121,259 B2 * 10/2006 Wayama ..... F02D 9/00 123/399
7,128,038 B2 * 10/2006 Kawai ..... F02D 9/1035 123/184.21
7,231,903 B2 * 6/2007 Wayama ..... F02D 9/1065 123/399
8,172,201 B2 5/2012 Veinotte et al.
8,490,947 B2 7/2013 Grewal
8,807,161 B2 8/2014 Wilby
9,145,854 B2 9/2015 Hodeburg et al.
9,238,979 B2 1/2016 Peterson et al.
2004/0123838 A1 * 7/2004 Hashimoto ..... F02D 9/105 123/399
2006/0042594 A1 * 3/2006 Wayama ..... F02D 9/00 123/399
2015/0059717 A1 3/2015 Maxim
2015/0337743 A1 11/2015 Cowan et al.

* cited by examiner

*Primary Examiner* — Long T Tran
(74) *Attorney, Agent, or Firm* — Howard & Howard Attorneys PLLC

(57) ABSTRACT

A valve assembly includes a valve housing defining a bore with a first axis extending along a length of the bore, and a valve shaft partially disposed within the bore along a second axis that is perpendicular to the first axis. The valve assembly additionally includes a valve plate coupled to the valve shaft and disposed within the bore, and a restricting device including a stop member and an engagement member. The stop member extends from the valve housing and presents a stop surface. The engagement member extends from the valve shaft and presents an engagement surface. At least one of the stop surface and the engagement surface is non-parallel with the second axis. The at least one non-parallel surface engages the other of the stop member and the engagement member and biases the valve shaft axially along the second axis.

23 Claims, 10 Drawing Sheets

VALVE ASSEMBLY AND VALVE SYSTEM INCLUDING SAME

BACKGROUND OF THE INVENTION

1. Field of the Invention

The subject invention generally relates to a valve assembly and a valve system for regulating fluid flow in an internal combustion engine.

2. Description of the Related Art

Valve systems including an actuator and a valve assembly are used in internal combustion engines for regulating fluid flow. Typically, the valve assembly includes a valve housing having an interior surface which defines a bore, with a first axis extending along a length of the bore, and with the bore having a bore diameter. The valve assembly also includes a valve shaft extending along a second axis perpendicular to the first axis and partially disposed within the bore. The valve assembly additionally includes a valve plate coupled to the valve shaft and disposed within the bore, with the valve plate moveable upon rotation of the valve shaft between a first position and a second position. The valve plate has a plate width along the second axis, with the plate width less than the bore diameter for allowing thermal expansion and contraction of the valve plate and for allowing tolerance during assembly of the valve plate. The valve assembly includes a stop device for preventing movement of the valve plate beyond the first or second position. Often, during use of the valve assembly, external forces, such as movement of components in the internal combustion engine, can cause forced vibrations resulting in axial movement of the valve shaft and the valve plate along the second axis due to manufacturing clearances of various components of the valve assembly. The axial movement causes wear on various components in the valve assembly, particularly the valve housing, the valve shaft, and the valve plate.

Traditionally, the stop device of the valve assembly only prevents movement of the valve plate beyond the first or second position, thereby biasing the valve shaft and the valve plate in a third direction perpendicular to the second axis. However, the valve shaft and the valve plate may still move axially along the second axis, which causes the wear in the valve assembly. Additionally, to further prevent movement of the valve shaft and the valve plate axially along the second axis, the actuator is provided with a holding current to increase the bias of the valve shaft against valve housing or other component of the valve assembly, such as a bushing, which additionally increases wear on the valve shaft, valve housing, and, when present, the bushing. As such, there remains a need to provide an improved valve system and valve assembly.

SUMMARY OF THE INVENTION AND ADVANTAGES

A valve assembly for regulating fluid flow in an internal combustion engine includes a valve housing having an exterior surface, and an interior surface which defines a bore. The bore has a length and a first axis extending along the length. The bore has a bore diameter measured radially from the first axis. The valve assembly also includes a valve shaft partially disposed and extending within the bore along a second axis that is perpendicular to the first axis. The valve shaft is rotatable about the second axis. The valve assembly additionally includes a valve plate coupled to the valve shaft and disposed within the bore. The valve plate is moveable upon rotation of the valve shaft between at least a first position for allowing fluid to flow within the bore, and a second position for restricting the fluid to flow within the bore. The valve plate has a plate width measured radially from the first axis that is less than the bore diameter thereby allowing axial movement of the valve shaft and the valve plate along the second axis. The valve assembly further includes a restricting device including a stop member and an engagement member. The stop member extends from the exterior surface of the valve housing and presents a stop surface. The engagement member extends from the valve shaft, is rotatable with the valve shaft, engageable with the stop member, and presents an engagement surface. At least one of the stop surface and the engagement surface is non-parallel with the second axis. The at least one non-parallel surface engages the other of the stop member and the engagement member and biases the valve shaft axially along the second axis in a first direction for preventing axial movement of the valve shaft and the valve plate along the second axis in a second direction different from the first direction.

Accordingly, the restricting device of the valve assembly restricts movement of the valve shaft and the valve plate axially along the second axis by biasing the valve shaft axially along the second axis in the first direction for preventing axial movement of the valve shaft and the valve plate along the second axis in a second direction different from the first direction. Specifically, the at least one non-parallel surface engages the other of the stop member and the engagement member and biases the valve shaft and the valve plate along the second axis in the first direction. The biasing of the valve shaft axially along the second axis in the first direction prevents axial movement of the valve shaft and the valve plate along the second axis in the second direction. Because the valve shaft and the valve plate cannot move axially, wear on various components of the valve assembly, particularly the valve housing, the valve shaft, and the valve plate, is reduced.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
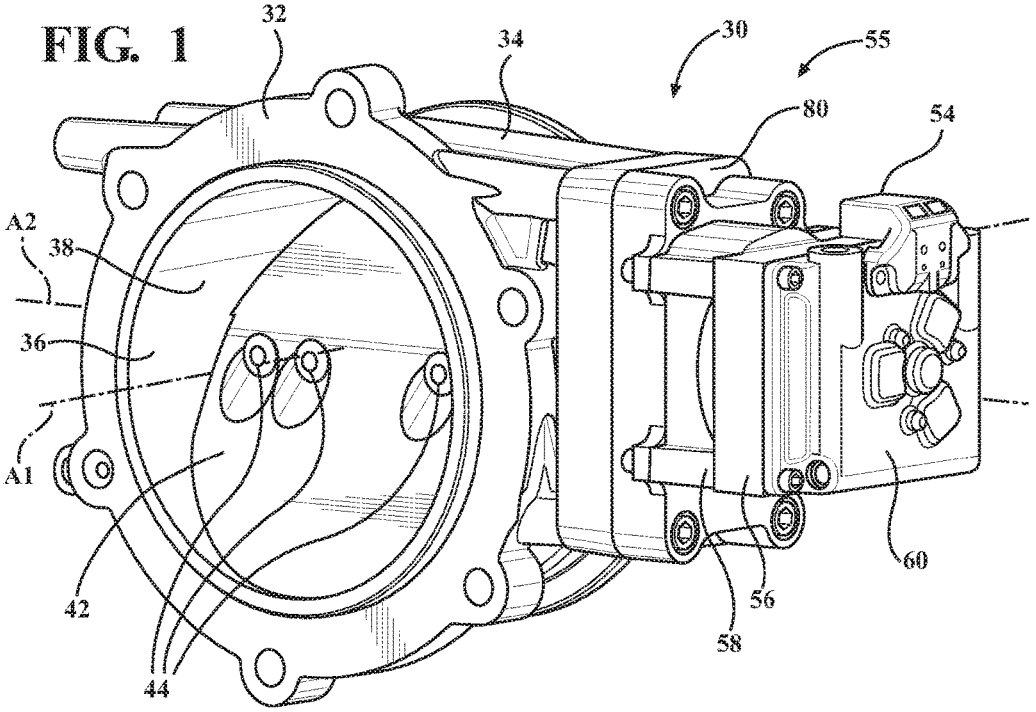
FIG. 1 is a perspective view of a valve system including a valve assembly and an actuator, with the valve assembly including a valve housing, a valve plate, and an adapter.

With reference to the Figures, wherein like numerals indicate like parts throughout the several views, a valve assembly 30 for regulating fluid flow in an internal combustion engine is generally shown in FIG. 1. The valve assembly 30 may be used to control flow of fluid for various functions of the internal combustion engine, such as controlling the intake of air into the internal combustion engine or controlling exhaust flow from the internal combustion engine. To control various functions of the internal combustion engine, the valve assembly 30 may be a flap style valve, a poppet valve, or a throttle valve; however, one having skill in the art will appreciate that the valve assembly 30 may be any other suitable valve. The valve assembly 30 may be used for any internal combustion engine, such as, but not limited to, automobiles, trucks, and locomotives.

The valve assembly 30 includes a valve housing 32 having an exterior surface 34 and an interior surface 36. The interior surface 36 defines a bore 38 having a length with a first axis A1 extending along the length of the bore 38. The bore 38 has a bore diameter D1 measured radially from the first axis A1. Depending on the application of the valve assembly 30, the bore 38 may receive and deliver air into the internal combustion engine for controlling the intake of air into the internal combustion engine. Alternatively, the bore 38 may receive and deliver exhaust gas for controlling exhaust flow from the internal combustion engine.

The valve assembly 30 additionally includes a valve shaft 40 partially disposed and extending within the bore 38 along a second axis A2. The second axis A2 is perpendicular to the first axis A1. The valve shaft 40 is rotatable about the second axis A2. The valve shaft 40 may be supported by the valve housing 32 for rotating the valve shaft 40 about the second axis A2. It is to be appreciated that the valve shaft 40 may be supported by another component of the valve assembly 30, as described in further detail below.

Figure 5:
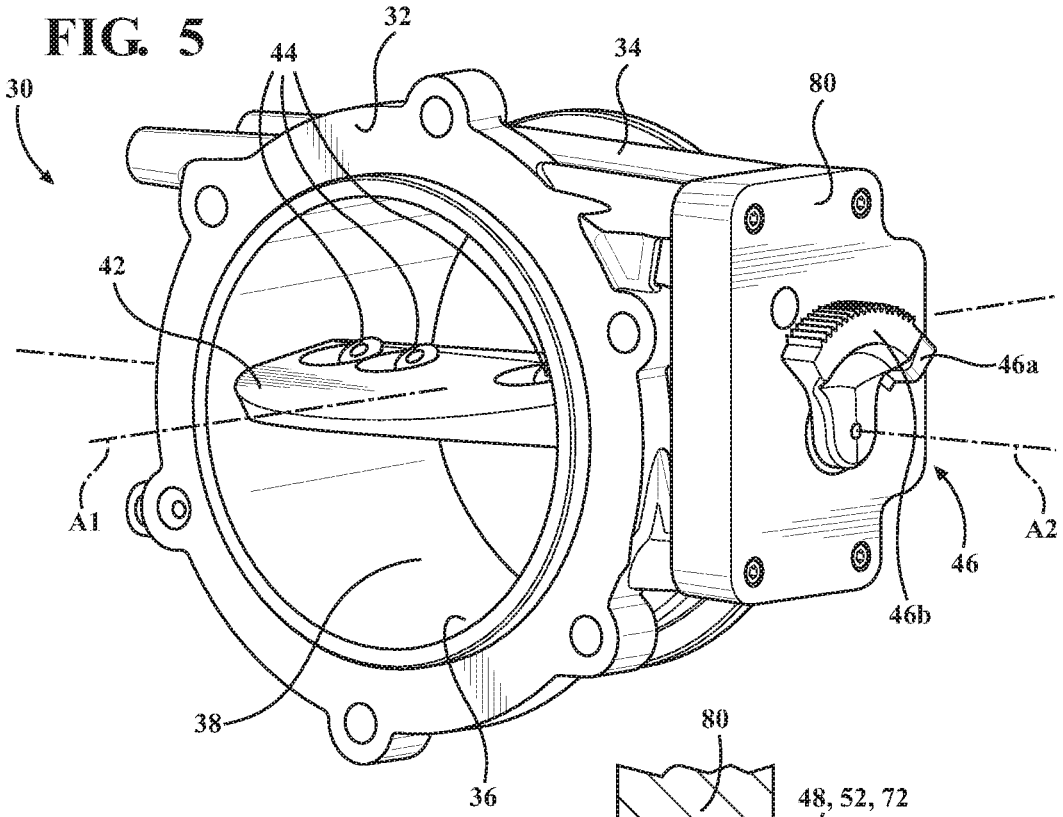
FIG. 5 is a perspective view of the valve assembly, with the valve plate in an first position, and with the engagement member engaging the stop member.

The valve assembly 30 further includes a valve plate 42 coupled to the valve shaft 40 and disposed within the bore 38. The valve plate 42 is moveable upon rotation of the valve shaft 40 between a first position for allowing fluid to flow within the bore 38, as shown in FIGS. 5, 18, and 20, and a second position for restricting the flow of fluid within the bore 38, as shown in FIGS. 1, 2, 4, 13-17, and 19. In some embodiments, the first position of the valve plate 42 is an open position and the second position of the valve plate 42 is a closed position. One having skill in the art will appreciate that the first and second positions of the valve plate 42 may be any position between the open position and the closed position. For example, the valve assembly 30 may be a modulating valve assembly 30 where the valve plate 42 is rotatable between any number of positions between the open and closed positions, as described in further detail below.

Figure 13:
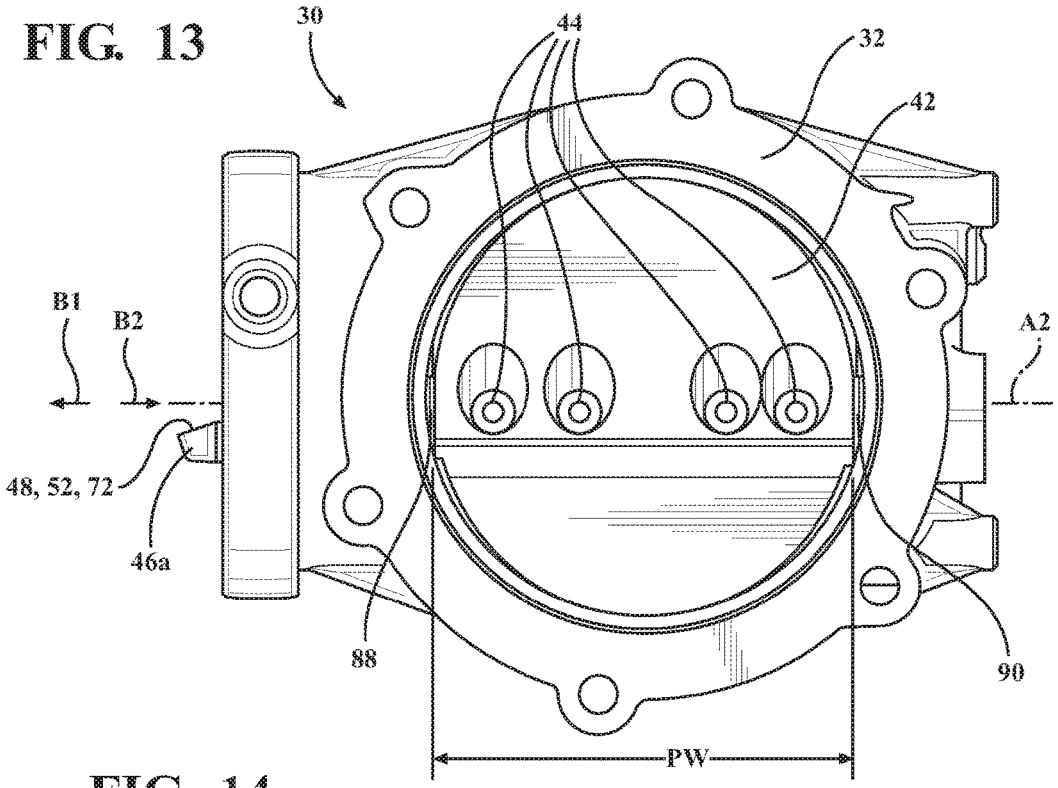
FIG. 13 is a side view of the valve assembly of FIG. 12, with the stop member integral with the valve housing.
Figure 14:
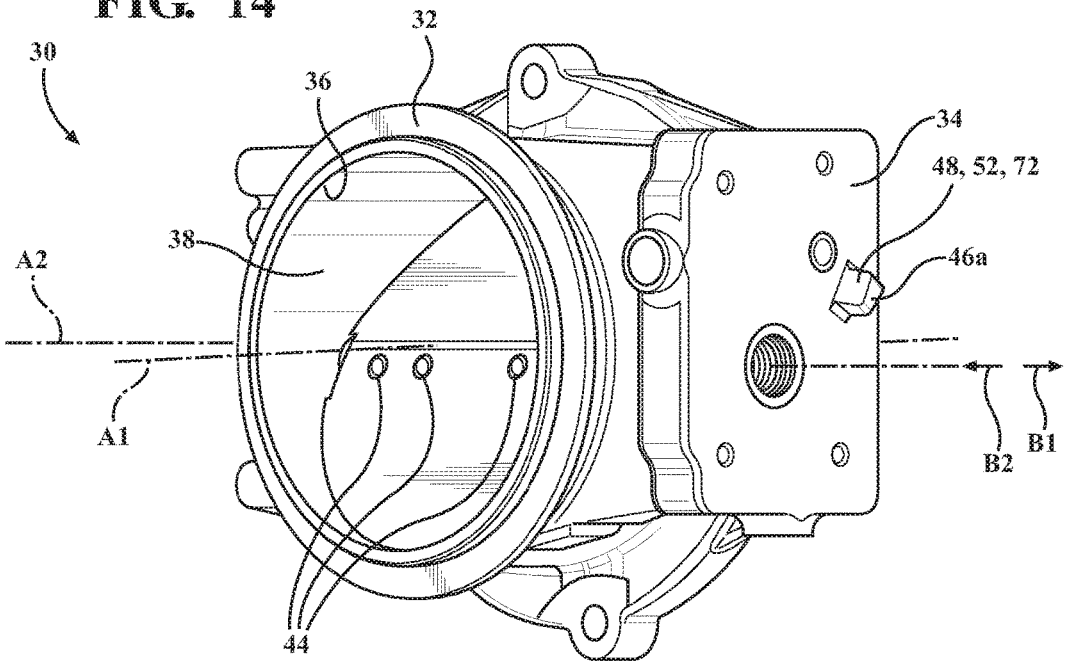
FIG. 14 is a perspective view of the valve assembly of FIG. 12, with the stop member integral with the valve housing.
Figure 15:
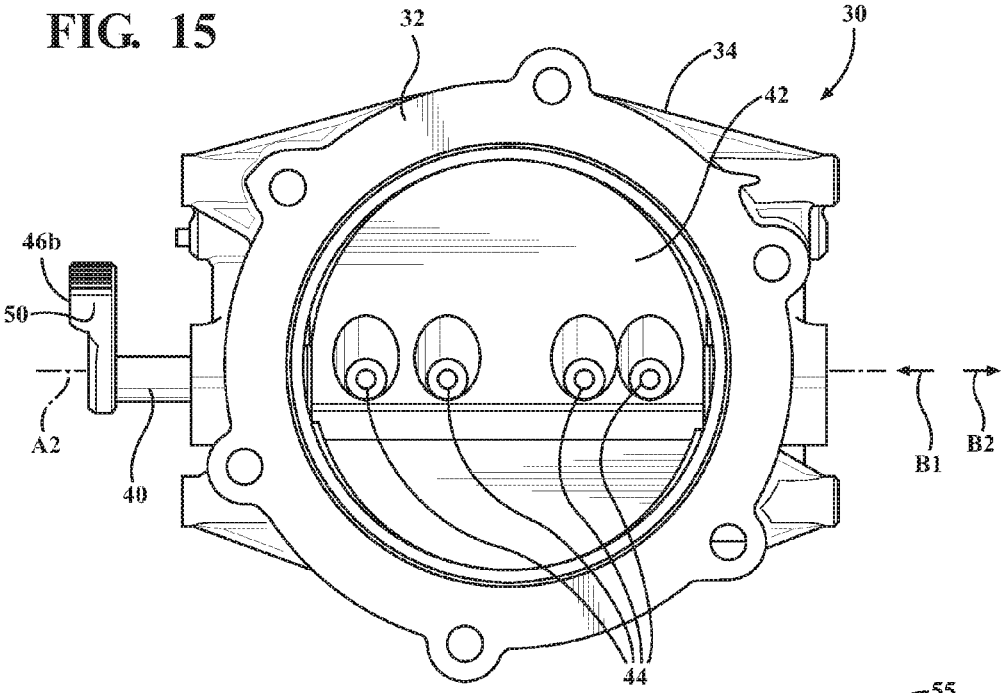
FIG. 15 is a side view of the valve assembly including the valve housing, the valve plate, the valve shaft, and the engagement member.

The valve plate 42 has a plate width PW, as best shown in FIG. 13, measured radially from the first axis A1 that is less than the bore diameter D1, thereby allowing axial movement of the valve shaft 40 and the valve plate 42 along the second axis A2. The plate width PW may be less than the bore diameter D1 to account for thermal expansion and contraction of the valve plate 42, to account for manufacturing tolerances, along with any other factor that may influence the bore diameter D1 and the plate width PW. Further, the plate width PW is less than the bore diameter D1 to allow the valve plate 42 to rotate within the bore 38 without engaging the valve housing 32. In one embodiment, the plate width PW is about 0.02 mm to about 0.06 mm less than the bore diameter D1. In yet another embodiment, the plate width PW is about 0.04 mm less than the bore diameter D1. One skilled in the art will appreciate that the plate width PW may be any dimension less than the bore diameter D1 without departing from the nature of the present invention.

Although it is desirable to have the plate width PW less than the bore diameter D1 for reasons described above, having the plate width PW less than the bore diameter D1 may cause undesirable effects. For example, when external forces are applied to the valve assembly 30, relative movement between the valve plate 42 and the valve housing 32 may occur. Examples of external forces include vibration, physical impact, and fluid pressure. Examples of fluid pressure providing the external forces include intake fluid pressure, intake fluid pulsations, exhaust gas pressure, and exhaust gas pulsations. Relative movement of the valve plate 42 and the valve shaft 40 relative to the valve housing 32 may cause wear on the valve plate 42, the valve shaft 40, and the valve housing 32. This wear may increase leakage of exhaust gas from the bore 38 of the valve housing 32, especially when the valve plate 42 is in the closed position.

The valve plate 42 may be attached to the valve shaft 40 by any suitable manner, such as using fasteners 44. The fasteners 44 may be screws, rivets, pins, and the like. The valve plate 42 may be welded onto the valve shaft 40. Moreover, the valve plate 42 may be integral with the valve shaft 40, i.e., one piece. The valve plate 42 is typically connected to and rotatable with the valve shaft 40.

The valve assembly 30 also includes a restricting device 46. The restricting device 46 includes a stop member 46*a* and an engagement member 46*b*. The stop member 46*a* extends from the exterior surface 34 of the valve housing 32 to present a stop surface 48. The engagement member 46*b* extends from the valve shaft 40 and is rotatable with the valve shaft 40. The engagement member 46*b* is engageable with the stop member 46*a* and presents an engagement surface 50. The engagement member 46*b* may extend directly from the exterior surface 34 of the valve housing 32. One having skill in the art will appreciate that the engagement member 46*b* may extend from another component relative to the exterior surface 34 of the valve housing 32.

At least one of the stop surface 48 and the engagement surface 50 is non-parallel with the second axis A2. The at least one non-parallel surface 52 engages the other of the stop member 46*a* and the engagement member 46*b* and biases the valve shaft 40 axially along the second axis in a first direction B1. In other words, when the stop surface 48 is non-parallel with the second axis A2, the other of the stop member 46*a* and the engagement member 46*b* is the engagement member 46*b*. Likewise, when the engagement surface 50 is non-parallel with the second axis A2, the other of the stop member 46*a* and the engagement member 46*b* is the stop member 46*a*. However, it is to be appreciated that both the stop surface 48 and the engagement surface 50 may be non-parallel with the second axis A2, as described in further detail below.

Engagement of the at least one non-parallel surface 52 and the other of the stop member 46*a* and the engagement member 46*b* prevents movement of the valve shaft 40 and the valve plate 42 along the second axis A2 in a second direction B2 different from the first direction B1. In one embodiment, the second direction B2 is opposite the first direction B1. In some embodiments, engagement of the at least one non-parallel surface 52 and the other of the stop member 46*a* and the engagement member 46*b* biases the valve shaft 40 radially from the second axis A2 in a third direction B3 different from the first and second directions B1, B2. The biasing of the valve shaft 40 radially from the second axis A2 in the third direction B3 prevents relative movement between the valve shaft 40, and the valve housing 32 and/or another component of the valve assembly 30, and may prevent rotation of the valve shaft 40 and movement of the valve plate 42 beyond one of the first and second positions. In such embodiments, the third direction B3 may be perpendicular to the first and second directions B1, B2. When the at least one non-parallel surface 52 and the other of the stop member 46*a* and the engagement member 46*b* engage one another, the biasing force in the first direction B1 and the third direction B3 may be referred to as a holding force. Depending on the application of the valve assembly 30, the biasing force in the third direction B3 may be about 50 kilograms, and the biasing force in the first direction B1 may be about 20 to 40 kilograms. As described in further detail below, the biasing force may be any suitable force and may be adjusted depending on the configuration of the stop member 46*a* and the engagement member 46*b*.

As described above, engagement of the at least one non-parallel surface 52 and the other of the stop member 46*a* and the engagement member 46*b* biases the valve shaft 40 and the valve plate 42 in the first direction B1 and the third direction B3. Biasing of the valve shaft 40 and the valve plate 42 in the first direction B1 and the third direction B3 reduces or eliminates relative movement of the valve plate 42 and the valve shaft 40 with respect to the valve housing 32, which can reduce wear of the valve plate 42, the valve shaft 40, and the valve housing 32. Specifically, biasing of the valve shaft 40 and the valve plate 42 in the first direction B1 reduces or eliminates axial movement along the second axis A2 of the valve shaft 40 and the valve plate 42, which reduces or eliminates undesired engagement and sliding engagement of the valve plate 42 and the valve housing 32 and/or any other component of the valve assembly 30, and the valve shaft 40 and the valve housing 32 and/or any other component of the valve assembly 30. Biasing of the valve shaft 40 and valve plate 42 in the third direction B3 reduces or eliminates movement of the valve shaft 40 and the valve plate 42 in a direction opposite the third direction B3, which reduces or eliminates undesired engagement of the valve shaft 40 and the valve housing 32 or other components of the valve assembly 30. Furthermore, as described above, engagement of the at least one non-parallel surface 52 and the other of the stop member 46*a* and the engagement member 46*b* may prevent movement of the valve plate 42 beyond the first or second position, which may be the open or closed position, or any other position in between the open and closed positions, as would be the case with the modulating valve assembly 30. Additionally, biasing of the valve shaft 40 and the valve plate 42 in the third direction B3 further prevents axial and radial movement of the valve shaft 40 and the valve plate 42 with the valve housing 32 and/or any other components of the valve assembly 30, and may prevent rotation of the valve shaft 40 and movement of the valve plate 42 beyond one of the first and second positions.

The rotation of the valve plate 42 is typically determined by the location of the non-parallel surface 52 and the other of the engagement member 46*b* and the stop member 46*a*. In other words, the valve plate 42 rotates a predetermined amount until the non-parallel surface 52 and the other of the engagement member 46*b* and the stop member 46*a* engage. Engagement of the non-parallel surface 52 and the other of the stop member 46*a* and the engagement member 46*b* prevents over rotation of the valve plate 42 beyond one of the first and second positions. For example, engagement of the non-parallel surface 52 and the other of the stop member 46*a* and the engagement member 46*b* may prevent the valve plate 42 from rotating beyond the first position, which may undesirably restrict the flow of fluid, and engagement of the non-parallel surface 52 and the other of the stop member 46*a* and the engagement member 46*b* may prevent the valve plate 42 from rotating beyond the second position, which may prevent engagement of the valve plate 42 and the interior surface 36 of the valve housing 32. Engagement of the valve plate 42 and the interior surface 36 of the valve housing 32 may cause wear on the valve plate 42 and the valve housing 32, which may reduce the ability of the valve plate 42 to restrict the flow of fluid through the bore 38.

Figure 17:
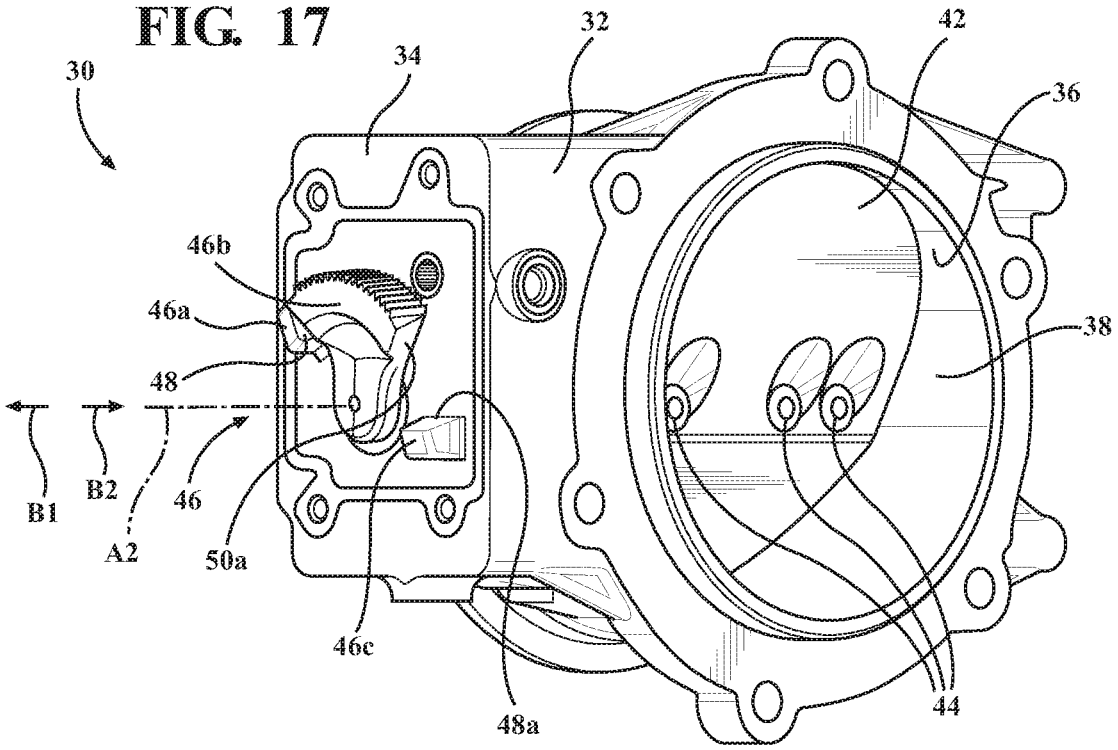
FIG. 17 is a perspective view of another embodiment of the restricting device, with the restricting device having a second stop member, with the first and second stop members integral with the valve housing, with the engagement member engaging the stop member, and with the valve plate in the second position.
Figure 18:
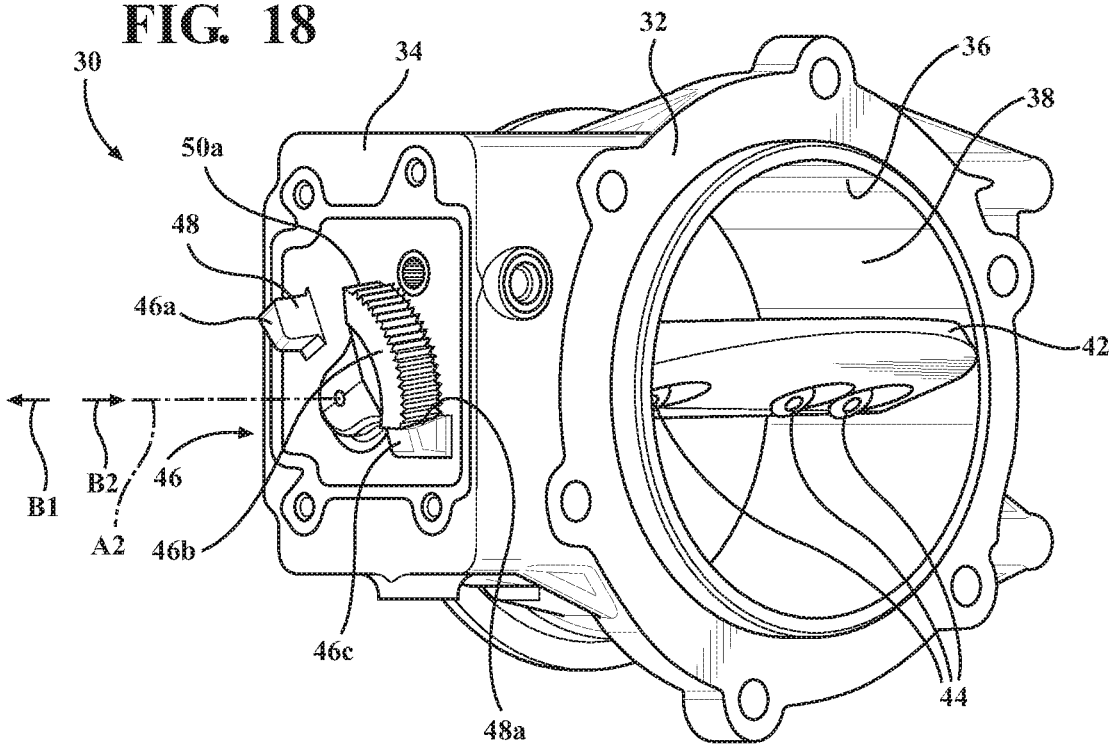
FIG. 18 is a perspective view of the restricting device of FIG. 17, with the engagement member engaging the second stop member, and with the valve plate in the first position.
Figure 19:
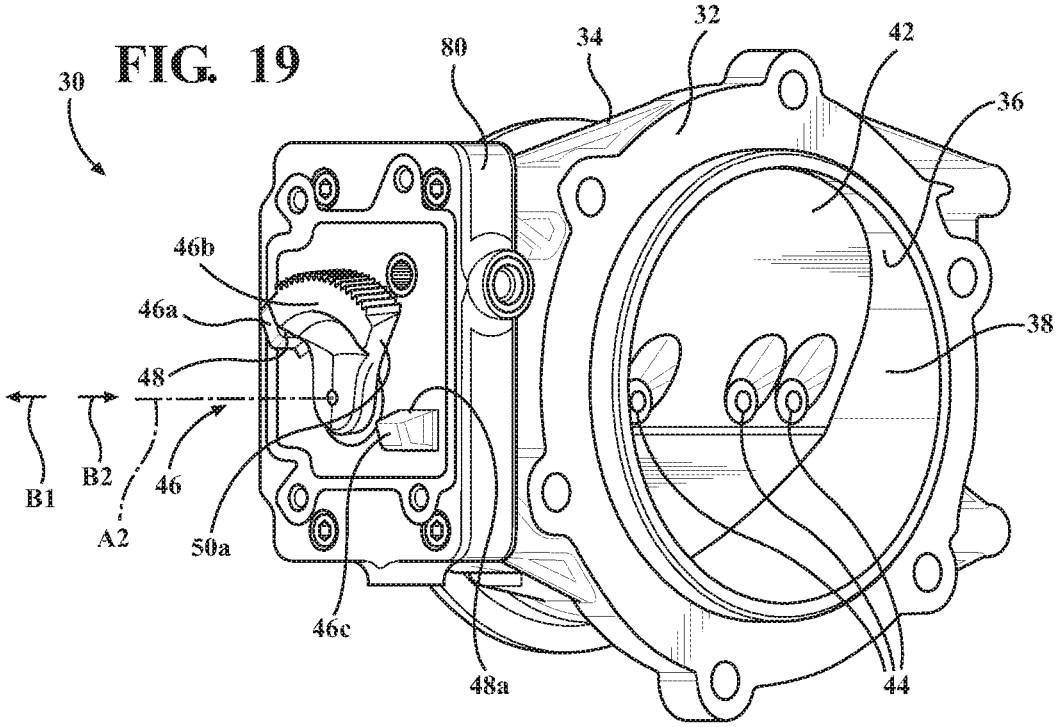
FIG. 19 is a perspective view of the restricting device of FIG. 17, with the first and second stop members integral with the adapter, and with the valve plate in the second position.
Figure 20:
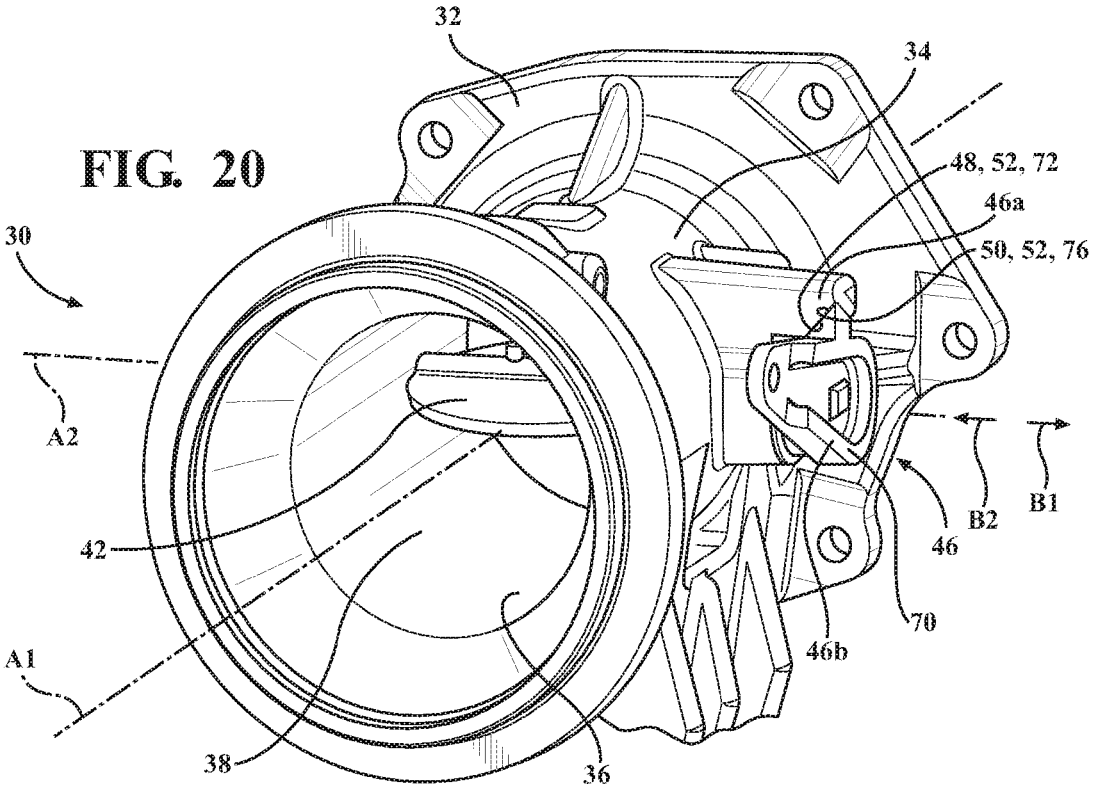
FIG. 20 is a perspective view of another embodiment of the restricting device.

In one embodiment, the restricting device 46 may include a second stop member 46*c*, as shown in FIGS. 17-19. In this embodiment, the engagement member 46*b* may engage the stop member 46*a* to prevent rotation of the valve plate 42 beyond the second position, as shown in FIG. 17, and the engagement member 46*b* may engage the second stop member 46*c* to prevent rotation of the valve plate 42 beyond the first position, as shown in FIG. 18. Specifically, the engagement member 46*b* may present a second engagement surface 50*a*, and the second stop member 46*c* may present a second stop surface 48*a*, with the second engagement surface 50*a* engageable with the second stop surface 48*a*. It is to be appreciated that description of the stop member 46*a* throughout the specification may also apply to the second stop member 46*c*. Furthermore, the description of the engagement surface 50 throughout the specification may also apply to the second engagement surface 50*a*. Additionally, the description of the stop surface 48 throughout the specification may also apply to the second stop surface 48*a*.

Figure 2:
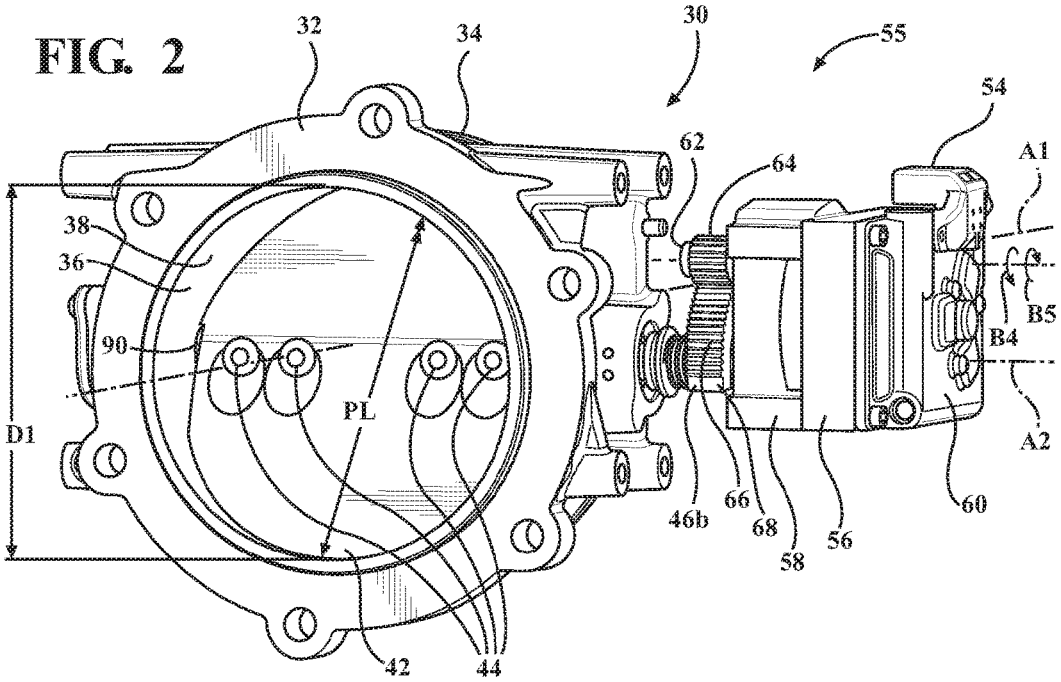
FIG. 2 is a perspective view of the valve system including the valve assembly and the actuator, with the valve assembly including the valve housing and the valve plate.
Figure 16:
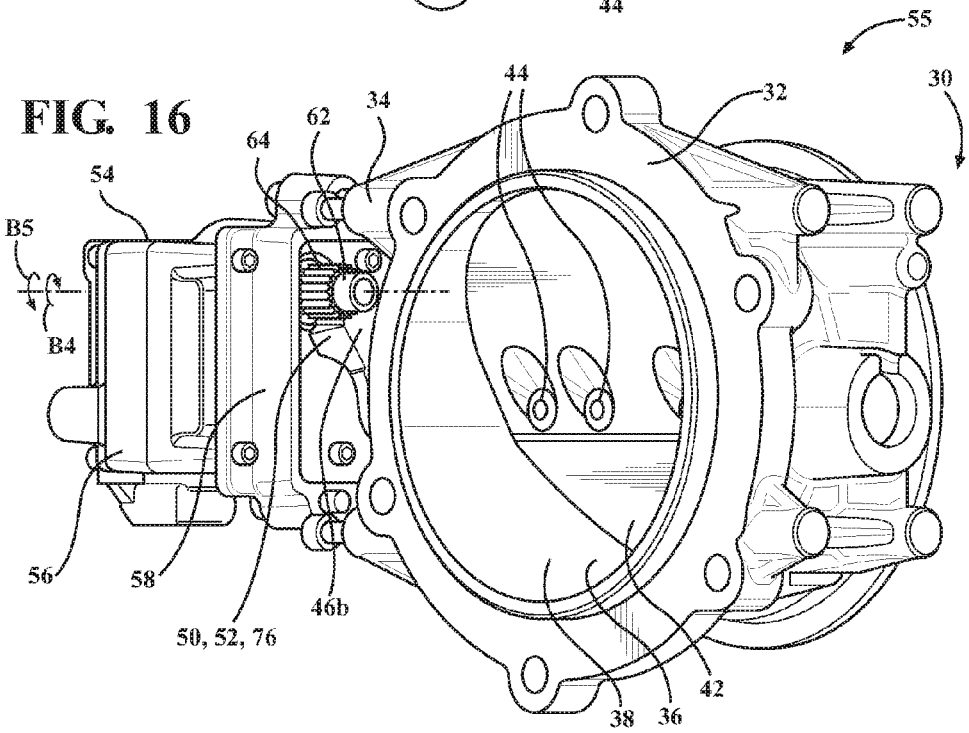
FIG. 16 is a perspective view of the valve system, with the actuator having an output shaft and a pinion gear, and with the pinion gear engaging the engagement member.

In one embodiment, the valve assembly 30 also includes an actuator 54, as shown in FIGS. 1, 2, and 16, for rotating the valve shaft 40 about the second axis A2. In this embodiment, the valve assembly 30 and the actuator 54 may be referred to as a valve system 55. The actuator 54 may be any suitable actuator for rotating the valve shaft 40, such as an electric motor, such as a brushless DC motor, an electric solenoid, a pneumatic solenoid, or a hydraulic solenoid. The actuator 54 may be mounted adjacent the restricting device 46. It is to be appreciated that the actuator 54 may be mounted opposite the restricting device 46 relative to the bore 38. Alternatively, the actuator 54 may be remotely mounted. For example, when the actuator is remotely mounted, the actuator is not mounted on the valve housing 32.

As shown in FIGS. 1, 2, and 16, the actuator 54 may have a first actuator housing 56 and a second actuator housing 58. The first actuator housing 56 and the second actuator housing 58 may be integral with one another. Alternatively, the first actuator housing 56 may be attached to the second actuator housing 58. One having skill in the art will appreciate that the first actuator housing 56 may be attached to the second actuator housing 58 in any suitable manner. The first and second actuator housings 56, 58 define an actuator housing interior. The valve assembly 30 may include an electric motor or an associated gear drive system disposed within the actuator housing interior. The valve assembly 30 may include an actuator cover 60 enclosing the first actuator housing 56. Various electrical connections and components may be enclosed by the actuator cover 60 or disposed within the actuator housing interior to provide electrical power to the actuator 54 and to control the actuator 54.

As best shown in FIGS. 2 and 16, the actuator 54 may have an output shaft 62 extending from the second actuator housing 58. The output shaft 62 is typically rotatable in response to an input force. For example, depending on the type of actuator, electrical power being supplied to the electric motor or electric solenoid, or fluid being supplied to the pneumatic or hydraulic solenoid. The actuator 54 may have a pinion gear 64 connected to the output shaft 62. The pinion gear 64 and the output shaft 62 of the actuator 54 will be described in further detail below.

In one embodiment, the valve plate 42 is in the first position when the at least one non-parallel surface 52 is engaged with the other of the stop member 46*a* and the engagement member 46*b*. When in the first position, the valve plate 42 may be substantially parallel to the first axis A1. Typically, when the valve plate 42 is substantially parallel to the first axis A1, the first position of the valve plate 42 is referred to as the open position. To be substantially parallel, the valve plate 42 is positioned relative to the valve housing 32 such that a maximum amount of fluid flows through the bore 38. In another embodiment, the valve plate 42 is in the second position, which may be referred to as the closed position, when the at least one non-parallel surface 52 is engaged with the other of the stop member 46*a* and the engagement member 46*b*. In one embodiment, the valve plate 42 has an oval configuration, with the valve plate 42 having a plate length PL perpendicular to the second axis A2, and with the plate length PL greater than the plate width PW. In one embodiment, when the valve plate 42 has the oval configuration, the valve plate 42 is in the second position and defines an angle with respect to the first axis A1 when the at least one non-parallel surface 52 is engaged with the other of the stop member 46*a* and the engagement member 46*b*. In one embodiment, the angle is about 55 degrees. However, it is to be appreciated that the angle may be greater or less than 55 degrees without departing from the nature of the present invention. Having the angle defined by the valve plate 42 and the first axis A1 less than 90 degrees helps eliminate the risk of the valve plate 42 being jammed within the bore 38. Having the angle less than 90 degrees allows the valve plate 42 to expand and contract due to the temperature of the fluid without binding against the interior surface 36 of the valve housing 32.

The engagement member 46*b* extends from the valve shaft 40 and may be integral with the valve shaft 40, i.e., one piece. In such embodiments, the valve shaft 40 and the engagement member 46*b* may be comprised of the same material. The engagement member 46*b* may be an independent component extending from the valve shaft 40. In such embodiments, the engagement member 46*b* and the valve shaft 40 may be separate materials or may be the same material. The engagement member 46*b* may extend perpendicular from the valve shaft 40. When the engagement member 46*b* extends perpendicular from the valve shaft 40, a distance between the stop member 46*a* and the valve shaft 40 may be decreased from when the engagement member 46*b* does not extend perpendicular from the valve shaft 40.

In one embodiment, as shown in FIGS. 2 and 4, 5, and 16-19, the engagement member 46*b* presents gear teeth 66 opposite the valve shaft 40 and radially disposed about the second axis A2. In this embodiment, the engagement member 46*b* is referred to as a drive gear 68, with the drive gear 68 presenting the engagement surface 50. The drive gear 68 shown throughout the Figures is a sector gear. When present, the gear teeth 66 may engage the pinion gear 64 such that the output shaft 62 transmits rotational motion to the pinion gear 64 and, in turn, to the engagement member 46*b*. As best shown in FIGS. 2 and 16, the actuator 54 rotates the output shaft 62 in a first output direction B4, with the rotational movement of the output shaft 62 translated to the pinion gear 64, which is then translated to the drive gear 68. When the rotational movement is translated to the drive gear 68, the drive gear 68 may translate rotational movement to the valve shaft 40, which, in turn, rotates the valve plate 42 such that the valve plate 42 moves with respect to the valve housing 32 and between the first and second positions. When the actuator 54 rotates the output shaft 62 in a second output direction B5 opposite the first output direction B4, rotational movement is successively translated to the pinion gear 64, from the pinion gear 64 to the drive gear 68, from the drive gear 68 to the valve shaft 40, and from the valve shaft 40 to the valve plate 42 such that the valve plate 42 moves with respect to the valve housing 32 between the first and second positions. It is to be appreciated that the drive gear 68 may be integrally formed with the valve shaft 40. Alternatively, a separate component may connect the drive gear 68 to the valve shaft 40 without departing from the nature of the invention. It is also to be appreciated that the drive gear 68 may be a separate component from the valve shaft 40 and may still extend from the valve shaft 40.

The drive gear 68 may be comprised of a plastic material, such as modified nylon 6-6 or 6-4, and/or polyphenelyne sulfide. Using the plastic material of the drive gear 68 helps reduce the weight of the valve assembly 30. The plastic material of the drive gear 68 may provide the engagement surface 50 with a lower coefficient of friction and/or a higher impact strength than a metallic material, such as powdered metal. However, it is to be appreciated that the drive gear 68 may be comprised of any suitable material without departing from the nature of the present invention. In one embodiment, the valve housing 32 is comprised of aluminum. Moreover, when the stop member 46*a* is integral with the valve housing 32, the stop member 46*a* may also be comprised of aluminum. To help with the coefficient of friction of the stop surface 48, the stop surface 48 may be machined to provide for a smooth stop surface 48. Binding of the engagement member 46*b* and the stop member 46*a* during engagement of the engagement surface 50 and the stop surface 48 may be reduced when the stop surface 48 and the engagement surface 50 have a low coefficient of friction.

In one embodiment, as shown in FIG. 20, the engagement member 46*b* may be referred to as a lever 70. In this embodiment, the lever 70 presents the engagement surface 50. Movement of the lever 70 may correspond to movement of the valve shaft 40. The valve shaft 40 may be rotated by the actuator 54. The lever 70 may be integral with the valve shaft 40, i.e., one piece, or the lever 70 may be a separate component extending from the valve shaft 40. In this embodiment, the stop member 46*a* extends from the exterior surface 34 of the valve housing 32. It is to be appreciated that the stop member 46*a* may extend from another component of the valve assembly 30 without departing from the nature of the present invention.

In certain embodiments, as shown in FIGS. 12-14, 17, and 18, the stop member 46*a* may be integral with the valve housing 32. In other embodiments, as shown in FIGS. 4-11 and 19, the stop member 46*a* may be integral with the actuator 54. It is to be appreciated that the stop member 46*a* may be integral with and may extend from any other component of the valve assembly 30 such that the engagement member 46*b* is engageable with the stop member 46*a* without departing from the nature of the present invention.

In one embodiment, as shown in FIGS. 4-9, 11-14, and 17-19, the stop surface is non-parallel with the second axis A2. When the stop surface 48 is non-parallel with the second axis A2, the stop surface 48 biases the valve shaft 40 and the valve plate 42 in the first direction B1 when the engagement member 46*b* engages the stop surface 48. In this embodiment, the stop surface 48 may be angled with respect to the second axis A2 and engageable with the engagement member 46*b*. In this embodiment, the stop surface 48 may be referred to as an angled stop surface 72, as best shown in FIGS. 4-7, 11-14, and 17-19. The angled stop surface 72 may also be referred to as a tapered stop surface. When the angled stop surface 72 is engaged by the engagement member 46*b*, the angled stop surface 72 may bias the valve shaft 40 axially along the second axis A2 in the first direction B1 to prevent axial movement of the valve shaft 40 and the valve plate 42 along the second axis A2 in the second direction B2. When the angled stop surface 72 is engaged by the engagement member 46*b*, the angled stop surface 72 may bias the valve shaft 40 radially from the second axis A2 in the third direction B3 to prevent relative movement between the valve shaft 40, and the valve housing 32 and/or another component of the valve assembly 30, and may prevent rotation of the valve shaft 40 and movement of the valve plate 42 beyond one of the first and second positions. In this embodiment, the angled stop surface 72 and the second axis A2 define a stop angle θ1.

The stop angle θ1 may be any degree between 1 and 89 such that the angled stop surface 72 biases the valve shaft 40 axially along the second axis A2 in the first direction B1 to prevent axial movement of the valve shaft 40 and the valve plate 42 along the second axis A2 in the second direction B2 opposite the first direction B1. The stop angle θ1 may be any degree between 1 and 89 such that the angled stop surface 72 biases the valve shaft 40 in the third direction B3 to prevent relative movement between the valve shaft 40, and the valve housing 32 and/or another component of the valve assembly 30, and may prevent rotation of the valve shaft 40 and movement of the valve plate 42 beyond one of the first and second positions. For example, in one embodiment, the stop angle θ1 may be from about 1 degree to about 35 degrees. In another embodiment, the stop angle θ1 may be from about 5 degrees to about 30 degrees. In yet another embodiment, the stop angle θ1 may be from about 10 degrees to about 15 degrees. One skilled in the art will appreciate that the stop angle θ1 may be adjusted accordingly to correspond with the biasing force necessary to bias the valve shaft 40 and the valve plate 42 in the first direction B1 and the third direction B3. For example, the stop angle θ1 determines the biasing force applied along the first direction B1 and the third direction B3. The higher the degree of the stop angle θ1, the greater the biasing force is in the first direction B1. However, the higher the degree of the stop angle θ1, the less the biasing force is in the third direction B3. Therefore, depending on the biasing force needed in the first direction B1 and the third direction B3, the stop angle θ1 may be adjusted accordingly. One having skill in the art will appreciate that a greater biasing force in the third direction B3 may be desired to further prevent axial and radial movement of the valve shaft 40 and the valve plate 42 with the valve housing 32 and/or any other components of the valve assembly 30, and may prevent rotation of the valve shaft 40 and movement of the valve plate 42 beyond one of the first and second positions.

Figure 8:
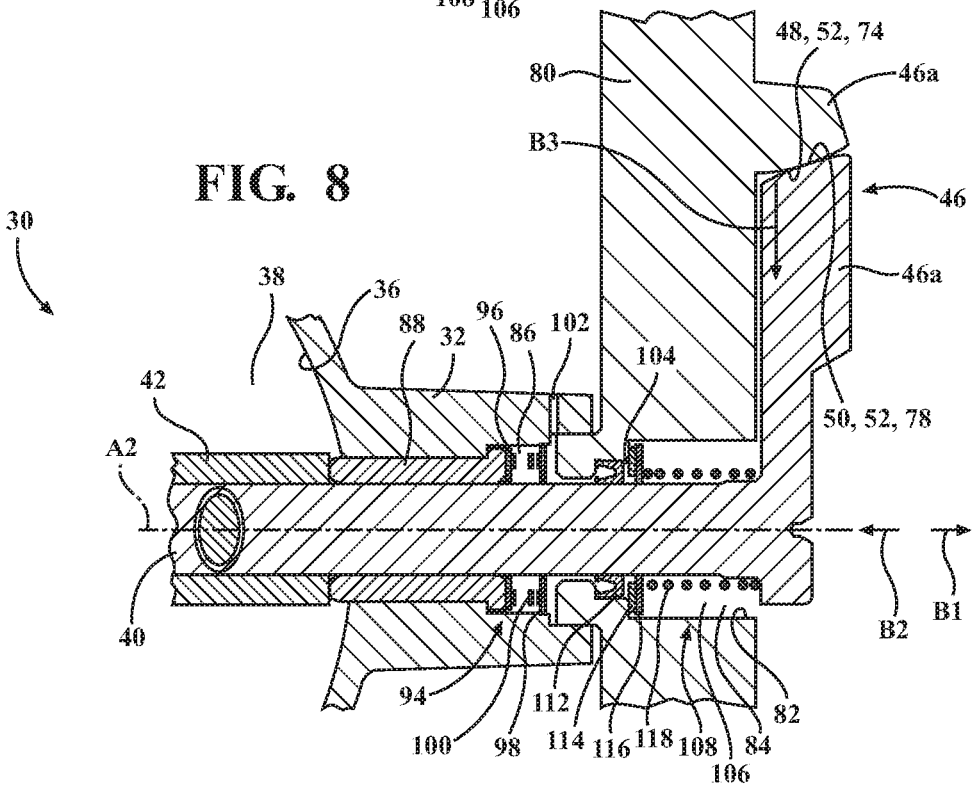
FIG. 8 is a side cross-sectional view of the valve assembly including the valve housing, the valve shaft, the valve plate, the restricting device, and the adapter, with the engagement member of FIG. 7 engaging another embodiment of the stop member.
Figure 9:
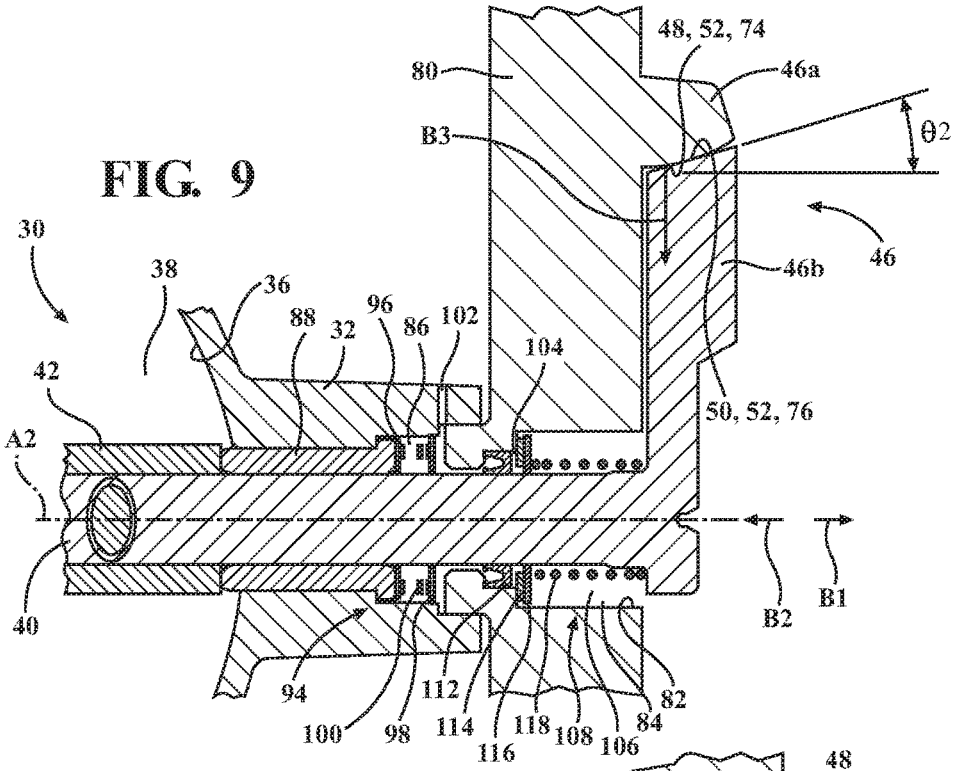
FIG. 9 is a side cross-sectional view of the valve assembly including the valve housing, the valve shaft, the valve plate, the restricting device, and the adapter, with the engagement member of FIG. 7 engaging the stop member of FIG. 8.
Figure 10:
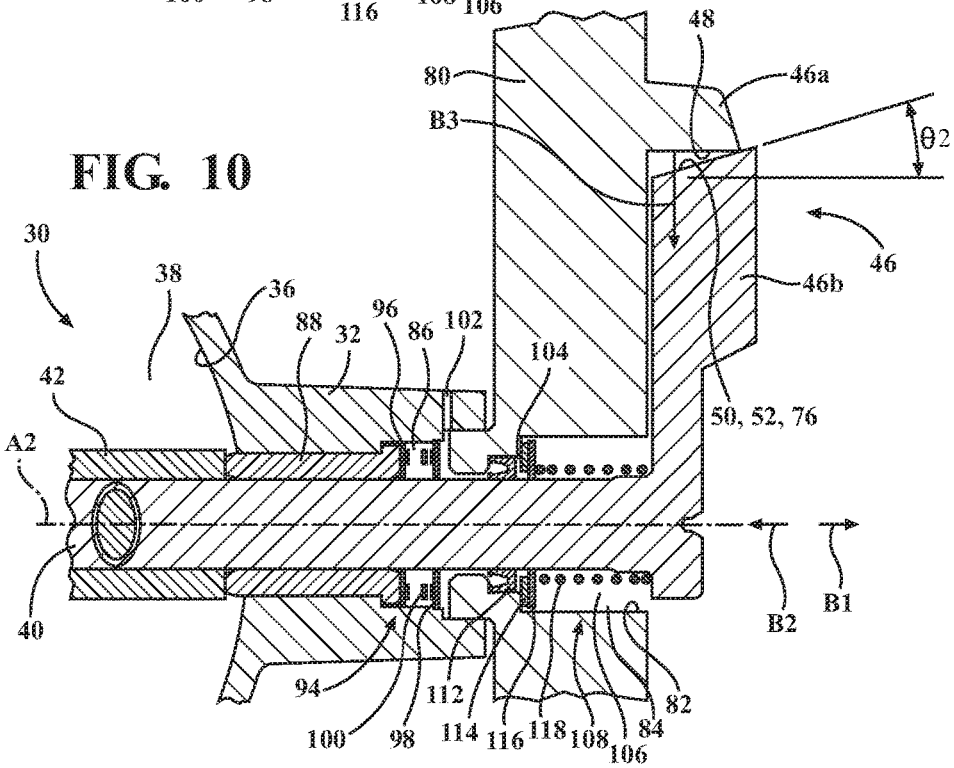
FIG. 10 is a side cross-sectional view of the valve assembly including the valve housing, the valve shaft, the valve plate, the restricting device, and the adapter, with the engagement member of FIG. 6 engaging another embodiment of the stop member.
Figure 11:
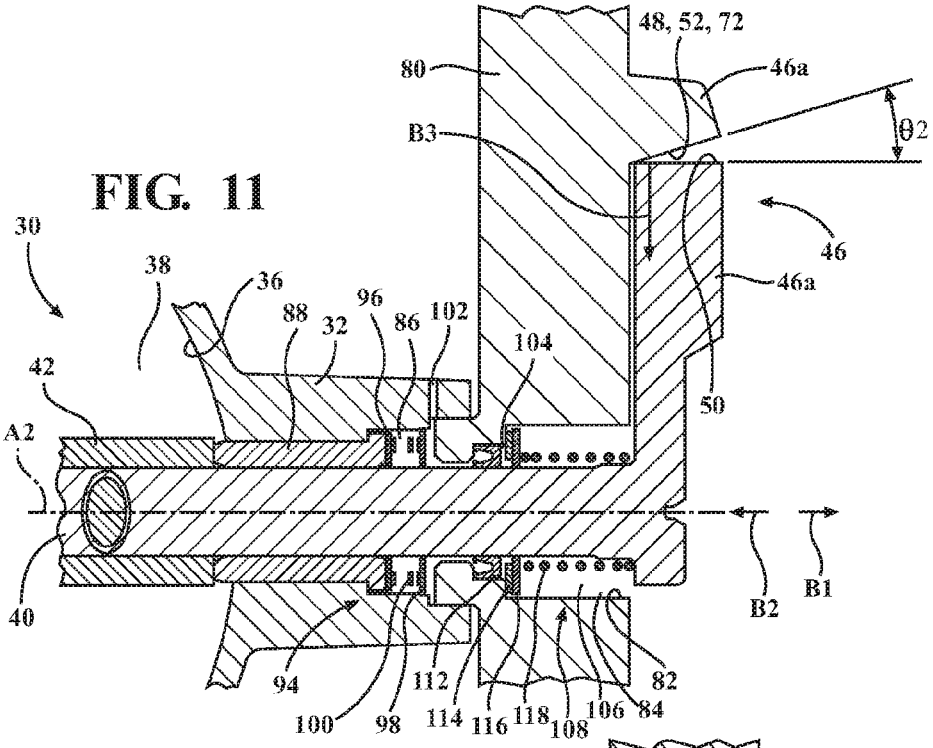
FIG. 11 is a side cross-sectional view of the valve assembly including the valve housing, the valve shaft, the valve plate, the restricting device, and the adapter, with another embodiment of the engagement member engaging the stop member of FIG. 10.

The stop surface 48 may be curved with respect to the second axis A2 and engageable with the engagement member 46*b*. In this embodiment, the stop surface 48 may be referred to as a curved stop surface 74, as best shown in FIGS. 8 and 9. The curved stop surface 74 may have an arcuate configuration. The curved stop surface 74 allows for greater tolerances for engagement between the stop surface 48 and the engagement member 46*b*. When the curved stop surface 74 is engaged by the engagement member 46*b*, the curved stop surface 74 may bias the valve shaft 40 axially along the second axis A2 in the first direction B1 to prevent axial movement of the valve shaft 40 and the valve plate 42 along the second axis A2 in the second direction B2. When the curved stop surface 74 is engaged by the engagement member 46*b*, the angled stop surface 72 may bias the valve shaft 40 radially from the second axis A2 in the third direction B3 to prevent relative movement between the valve shaft 40, and the valve housing 32 and/or another component of the valve assembly 30, and may prevent rotation of the valve shaft 40 and movement of the valve plate 42 beyond one of the first and second positions.

In one embodiment, as shown in FIGS. 4-9, 11-14, and 17-19, the engagement surface is non-parallel with the second axis A2. When the engagement surface 50 is non-parallel with the second axis A2, the engagement surface 50 biases the valve shaft 40 and the valve plate 42 in the first direction B1 when the engagement surface 50 engages the stop member 46*a*. In this embodiment, the engagement surface 50 may be angled with respect to the second axis A2 and engageable with the stop member 46*a*. In this embodiment, the engagement surface 50 may be referred to as an angled engagement surface 76, as best shown in FIGS. 4-6, 10, 12, and 16-19. The angled engagement surface 76 may be referred to as a tapered engagement surface. When the angled engagement surface 76 engages the stop member 46*a*, the angled engagement surface 76 may bias the valve shaft 40 axially along the second axis A2 in the first direction B1 to prevent axial movement of the valve shaft 40 and the valve plate 42 along the second axis A2 in the second direction B2. Furthermore, when the angled engagement surface 76 engages the stop member 46*a*, the angled engagement surface 76 may bias the valve shaft 40 radially from the second axis A2 in the third direction B3 to prevent relative movement between the valve shaft 40, and the valve housing 32 and/or another component of the valve assembly 30, and may prevent rotation of the valve shaft 40 and movement of the valve plate 42 beyond one of the first and second positions. In this embodiment, the angled engagement surface 76 and the second axis A2 define an engagement angle θ2.

The engagement angle θ2 may be any degree between 1 and 89 such that the angled engagement surface 76 biases the valve shaft 40 axially along the second axis A2 in the first direction B1 to prevent axial movement of the valve shaft 40 and the valve plate 42 along the second axis A2 in the second direction B2 opposite the first direction B1, and biases the valve shaft 40 radially perpendicular to the second axis A2 in the third direction B3 perpendicular to the first and second directions B1, B2 to prevent relative movement between the valve shaft 40, and the valve housing 32 and/or another component of the valve assembly 30, and may prevent rotation of the valve shaft 40 and movement of the valve plate 42 beyond one of the first and second positions. For example, in one embodiment, the engagement angle θ2 may be from about 1 degree to about 35 degrees. In another embodiment, the engagement angle θ2 may be from about 5 degrees to about 30 degrees. In yet another embodiment, the engagement angle θ2 may be from about 10 degrees to about 15 degrees. Similar to the stop angle θ1 described above, one skilled in the art will appreciate that the engagement angle θ2 may be adjusted accordingly to provide the necessary biasing force in the first direction B1 and the third direction B3.

Figure 7:
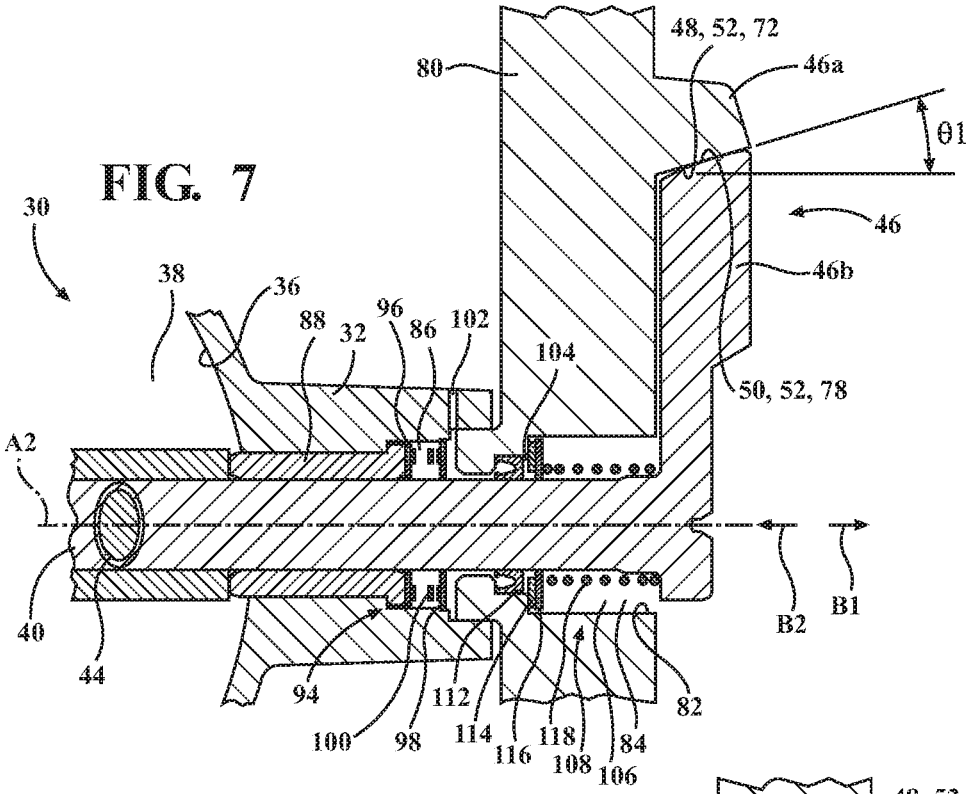
FIG. 7 is a side cross-sectional view of the valve assembly including the valve housing, the valve shaft, the valve plate, the restricting device, and the adapter, with another embodiment of the engagement member engaging the stop member of FIG. 6.

The engagement surface 50 may be curved with respect to the second axis A2 and engageable with the stop member 46*a*. In this embodiment, the engagement surface 50 may be referred to as a curved engagement surface 78, as best shown in FIGS. 7 and 8. The curved engagement surface 78 may have an arcuate configuration. The curved engagement surface 78 allows for greater tolerances for engagement between the engagement surface 50 and the stop member 46*a*. When the curved engagement surface 78 engages the stop member 46*a*, the curved engagement surface 78 may bias the valve shaft 40 axially along the second axis A2 in the first direction B1 to prevent axial movement of the valve shaft 40 and the valve plate 42 along the second axis A2 in the second direction B2. When the curved engagement surface 78 engages the stop member 46*a*, the curved engagement surface 78 may bias the valve shaft 40 radially from the second axis A2 in the third direction B3 to prevent relative movement between the valve shaft 40, and the valve housing 32 and/or another component of the valve assembly 30, and may prevent rotation of the valve shaft 40 and movement of the valve plate 42 beyond one of the first and second positions.

In one embodiment, the stop surface 48 is non-parallel with the second axis A2 and the engagement surface 50 is non-parallel with the second axis A2, as shown in FIGS. 4-9 and 17-19. In such embodiments, the engagement surface 50 is engageable with the stop surface 48. In this embodiment, the stop surface 48 may be angled with respect to the second axis A2 and the engagement surface 50 may be angled with respect to the second axis A2, as shown in FIGS. 4-6, 12, 17-19. When the stop surface 48 and the engagement surface 50 are angled with respect to the second axis A2, the stop surface 48 may be referred to as the angled stop surface 72 and the engagement surface 50 may be referred to as the angled engagement surface 76. During engagement of the angled stop surface 72 and the angled engagement surface 76, the angled stop surface 72 biases against the angled engagement surface 76 to bias the valve shaft 40 axially along the second axis A2 in the first direction B1 to prevent axial movement of the valve shaft 40 and the valve plate 42 along the second axis A2 in the second direction B2. During engagement of the angled stop surface 72 and the angled engagement surface 76, the angled stop surface 72 may bias against the angled engagement surface 76 to bias the valve shaft 40 radially from the second axis A2 in the third direction B3 to prevent relative movement between the valve shaft 40, and the valve housing 32 and/or another component of the valve assembly 30, and may prevent rotation of the valve shaft 40 and movement of the valve plate 42 beyond one of the first and second positions.

Figure 6:
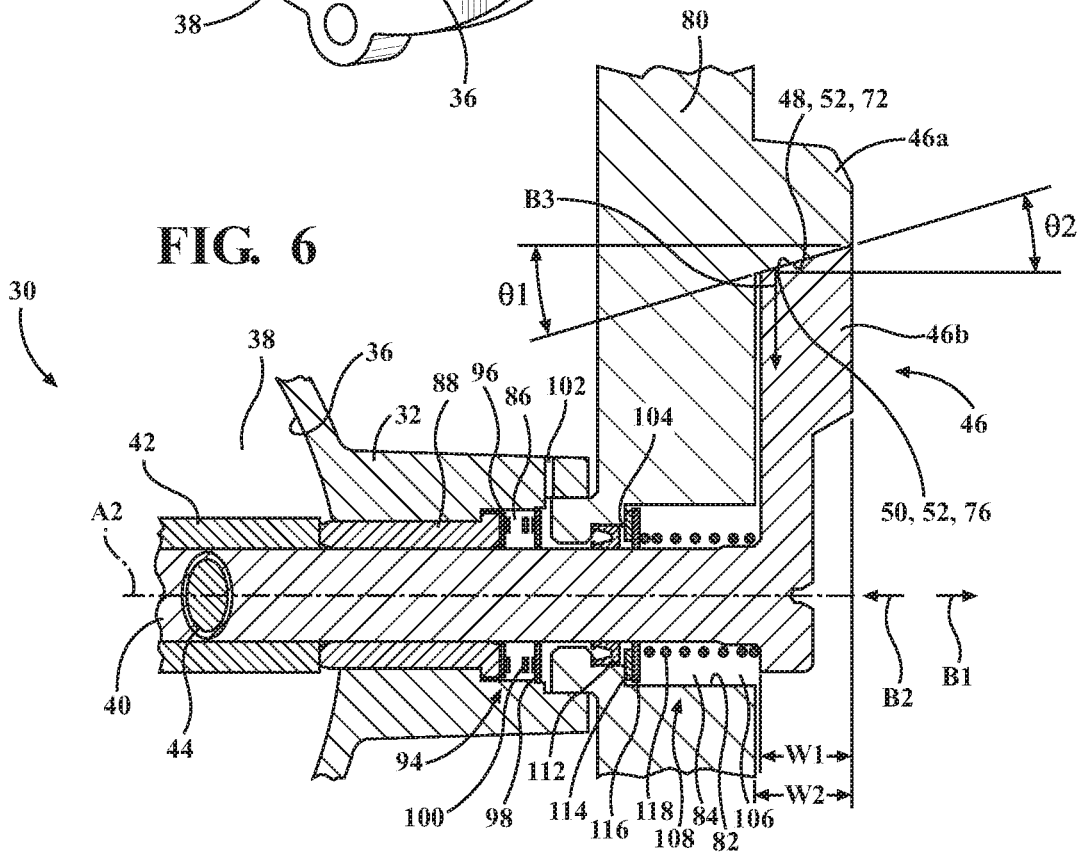
FIG. 6 is a side cross-sectional view of the valve assembly of FIG. 5 including the valve housing, the valve shaft, the valve plate, the restricting device, and the adapter, with the engagement member engaging the stop member.
Figure 12:
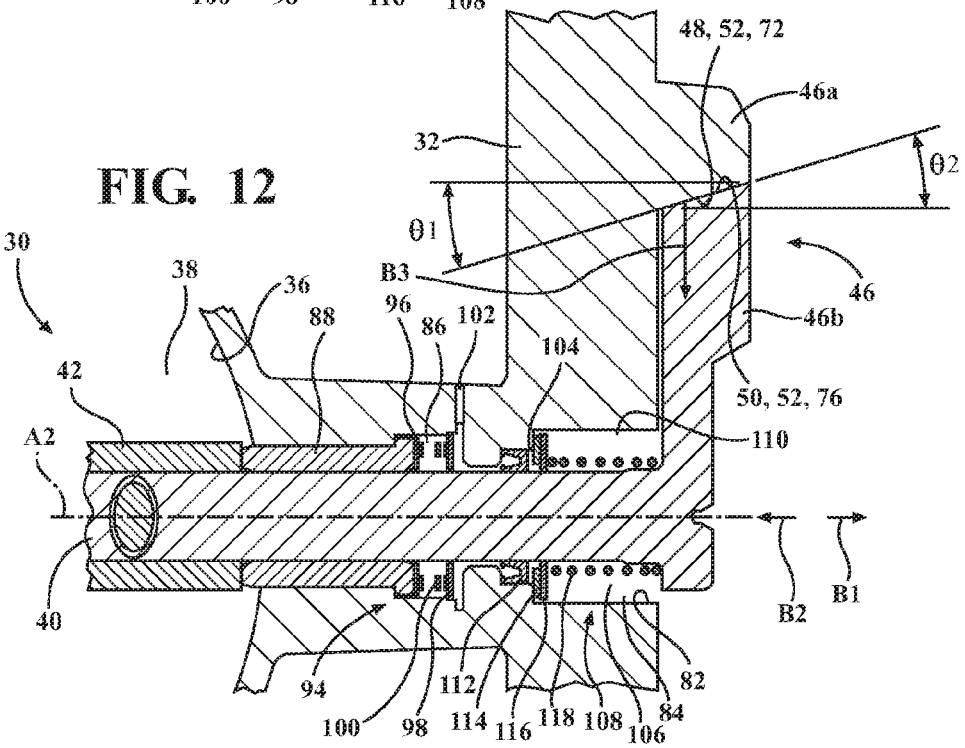
FIG. 12 is a side cross-sectional view of the valve assembly including the valve housing, the valve shaft, the valve plate, and the restricting device, with the stop member integral with the valve housing.

In one embodiment, when the stop surface 48 is angled with respect to the second axis A2 and the engagement surface 50 is angled with respect to the second axis A2, the angled stop surface 72 and the angled engagement surface 76 are parallel to one another, as best shown in FIGS. 6 and 12. Said differently, the stop angle θ1 defined by the angled stop surface 72 and the second axis A2 and the engagement angle θ2 defined by the angled engagement surface 76 and the second axis A2 are equal to one another. When the angled stop surface 72 and the angled engagement surface 76 are parallel to one another, the angled stop surface 72 and the angled engagement surface 76 face one another such that forces caused from the angled engagement surface 76 impacting and engaging the angled stop surface 72 may be evenly distributed across both the angled engagement surface 76 and the angled stop surface 72.

With reference to FIG. 6, the engagement member 46*b* may define an engagement width W1 and the stop member 46*a* may define a stop width W2. The engagement width W1 and the stop width W2 are determined based on the load characteristics needed during engagement of the stop member 46*a* and the engagement member 46*b*. For example, the engagement width W1 and the stop width W2 may be greater to account for higher impact and stress than when lower impact and stress caused during engagement of the engagement member 46*b* and the stop member 46*a*. In one embodiment, the engagement width W1 and the stop width W2 are equal to one another. In another embodiment, the engagement width W1 is less than the stop width W2.

When the stop surface 48 is non-parallel with the second axis A2 and the engagement surface 50 is non-parallel with the second axis A2, the stop surface 48 may be curved with respect to the second axis A2 and the engagement surface 50 may be curved with respect to the second axis A2, as shown in FIG. 8. When the stop surface 48 and the engagement surface 50 are curved with respect to the second axis A2, the stop surface 48 may be referred to as the curved stop surface 74 and the engagement surface 50 may be referred to as the curved engagement surface 78. During engagement of the curved stop surface 74 and the curved engagement surface 78, the curved stop surface 74 biases against the curved engagement surface 78 to bias the valve shaft 40 axially along the second axis A2 in the first direction B1 to prevent axial movement of the valve shaft 40 and the valve plate 42 along the second axis A2 in the second direction B2. During engagement of the curved stop surface 74 and the curved engagement surface 78, the curved stop surface 74 may bias against the curved engagement surface 78 to bias the valve shaft 40 radially from the second axis A2 in the third direction B3 to prevent relative movement between the valve shaft 40, and the valve housing 32 and/or another component of the valve assembly 30, and may prevent rotation of the valve shaft 40 and movement of the valve plate 42 beyond one of the first and second positions.

It is to be appreciated that when the stop surface 48 is non-parallel with the second axis A2, the engagement surface 50 may be parallel with the second axis A2. Alternatively, when the stop surface 48 is non-parallel with the second axis A2, the engagement surface 50 may be non-parallel with the second axis A2. When the stop surface 48 is non-parallel with the second axis A2 and the engagement surface 50 is non-parallel with the second axis A2, the engagement surface 50 may curved, arcuate, tapered, obliquely oriented, and/or angled with respect to the second axis. It is to be appreciated that when the engagement surface 50 is non-parallel with the second axis A2, the stop surface may be parallel with the second axis A2. Alternatively, when the engagement surface 50 is non-parallel with the second axis A2, the stop surface 48 may be non-parallel with the second axis A2. When the engagement surface 50 is non-parallel with the second axis A2 and the stop surface 48 is non-parallel with the second axis A2, the stop surface 48 may be curved, arcuate, tapered, obliquely oriented, and/or angled with respect to the second axis A2. It is to be appreciated that any combination of non-parallel, curved, arcuate, tapered, obliquely oriented, and angled surfaces for the engagement member 46*b* and the stop member 46*a* may be used without departing from the nature of the present invention.

The valve assembly 30 may include an adapter 80 adjacent the valve housing 32. The adapter 80 may have an interior adapter surface 82 defining an adapter cavity 84 about the second axis A2, and a portion of the valve shaft 40 may be disposed within the adapter cavity 84. The stop member 46*a* may extend from the adapter 80. In one embodiment, the stop member 46*a* is integral with the adapter 80, as shown in FIGS. 4-11 and 19.

The adapter 80 provides an advantage in assembling the valve assembly 30 by helping reduce the overall manufacturing cost and timing. Additionally, as described in further detail below, the adapter cavity 84 allows for easier installation of various components of the valve assembly 30.

Figure 3:
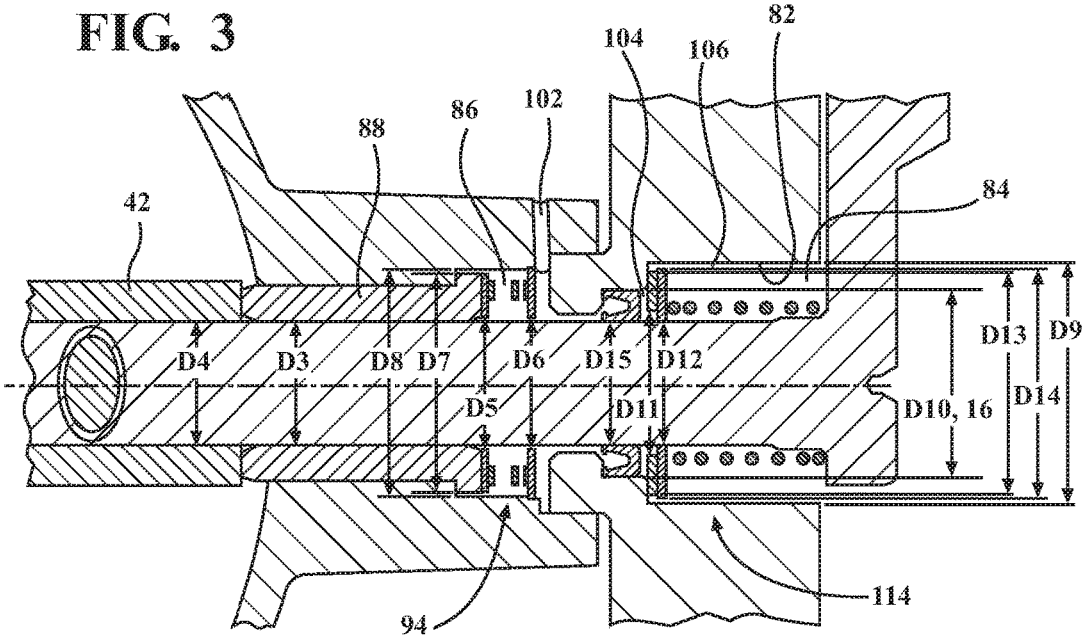
FIG. 3 is side cross-sectional view of the valve assembly shown in FIG. 2, with the valve housing defining a housing cavity and the adapter defining an adapter cavity, and with the valve assembly including a first sealing assembly disposed in the housing cavity, a second sealing assembly disposed in the adapter cavity, and a valve shaft.
Figure 4:
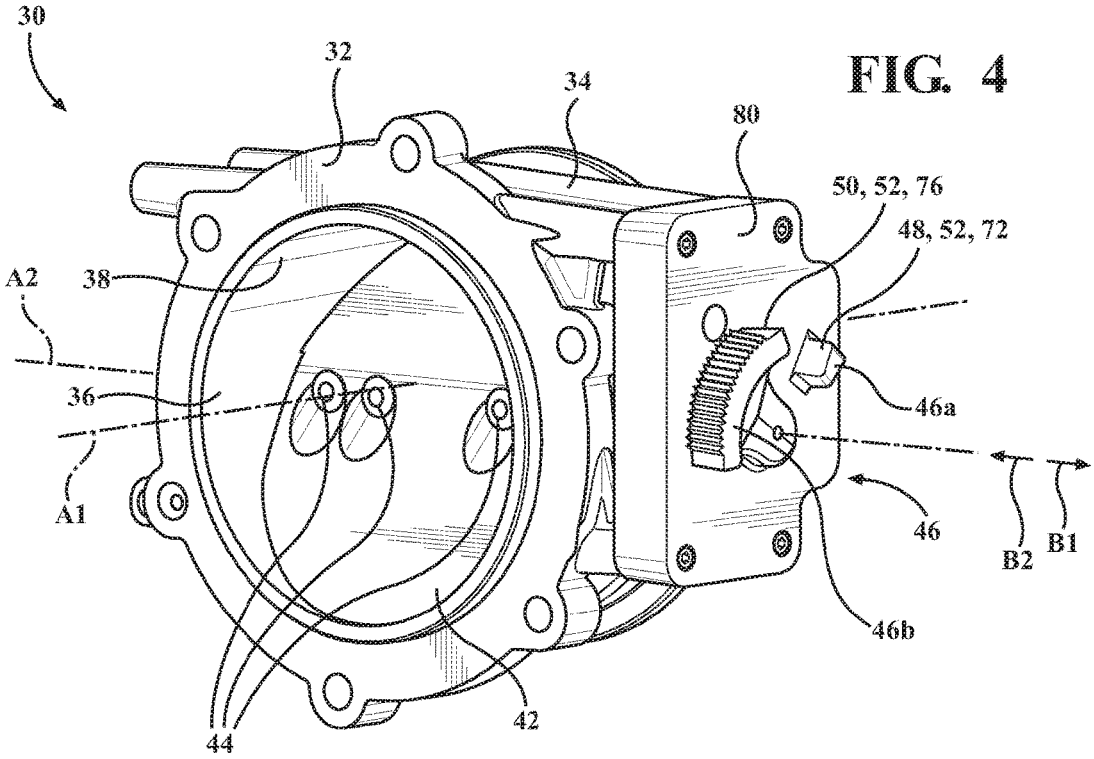
FIG. 4 is a perspective view of the valve assembly, with the valve assembly including a restricting device, with the restricting device having an engagement member and a stop member, and with the valve plate in a second position.

With reference to FIG. 3, the interior surface 36 of the valve housing 32 may define a housing cavity 86 about the second axis A2 and adjacent the bore 38. The valve assembly 30 may further include a bushing 88 disposed within the housing cavity 86. When present, the bushing 88 is coaxial with the second axis A2 and disposed about the valve shaft 40 for supporting the valve shaft 40 during rotation and during engagement of the at least one non-parallel surface 52 and the other of the stop member 46*a* and the engagement member 46*b* to bias the valve shaft 40 in the third direction B3. The bushing 88 may provide a bearing surface for the valve shaft 40 to rotate about and engage. The bushing 88 may be comprised of metal. The bushing 88 may have a bushing diameter D3, as best shown in FIG. 3. that is greater than the shaft diameter D4 for allowing rotation of the valve shaft 40 and for allowing manufacturing tolerances, thermal expansion and contraction, and other various factors. As the valve shaft 40 and the valve plate 42 are biased in the first direction B1 by engagement of the non-parallel surface 52 and the other of the engagement member 46*b* and the stop member 46*a*, the valve plate 42 may engage the bushing 88. The engagement of the valve shaft 40 and the bushing 88 may prevent further movement of the valve shaft 40 and the valve plate 42 along the second axis A2, which typically reduces wear of the valve shaft 40, the valve plate 42, and the valve housing 32. The non-parallel surface 52 may bias the valve shaft 40 radially from the second axis A2 in the third direction B3 into the bushing 88 to prevent relative movement between the valve shaft 40, and the valve housing 32 and/or another component of the valve assembly 30, and may prevent rotation of the valve shaft 40 and movement of the valve plate 42 beyond one of the first and second positions. The non-parallel surface 52 may bias the valve shaft 40 radially from the second axis A2 in the third direction B3 into the bushing 88 to prevent radial movement of the valve shaft 40 and the valve plate 42 with respect to the second axis A2.

The valve assembly 30 may include a second bushing 90 coaxial with the second axis A2 and disposed about the valve shaft 40, as shown in FIG. 2. The second bushing 90 may provide a bearing surface for the valve shaft 40 to rotate about and engage. The second bushing 90 may have a second bushing diameter that is greater than the shaft diameter D4 for allowing rotation of the valve shaft 40 and for allowing manufacturing tolerances, thermal expansion and contraction, and other various factors. The second bushing diameter may be equal to the bushing diameter D3.

A fluid may leak between the second bushing 90 and the valve shaft 40. To prevent leakage of fluid from the bore 38 and between the valve shaft 40 and the second bushing 90, the valve assembly 30 may include a housing cover (not shown, but generally known in the art) attached to the valve housing 32. The bushing diameter D3 and the second bushing diameter may be greater than the shaft diameter D4 to account for thermal expansion and contraction of the valve shaft 40, to account for manufacturing tolerances, and to account for any other factor that may influence the shaft diameter D4, the bushing diameter D3, and the second bushing diameter. Further, the shaft diameter D4 is less than the bushing diameter D3 and the second bushing diameter to allow the valve plate 42 to rotate within the bore 38. Although it is desirable to have the shaft diameter D4 less than the bushing diameter D3 and the second bushing diameter for reasons described above, having the shaft diameter D4 less than the bushing diameter D3 and the second bushing diameter may cause undesirable effects. For example, when external forces are applied to the valve assembly 30 in general, relative movement between the valve shaft 40 and the bushing 88 and the second bushing 90 may cause wear on the valve shaft 40, the bushing 88, and the second bushing 90. This wear may increase leakage of exhaust gas from the bore 38 of the valve housing 32, especially when the valve plate 42 is in the closed position. As described above, engagement of the at least one non-parallel surface 52 and the other of the stop member 46*a* and the engagement member 46*b* biases the valve shaft 40 and the valve plate 42 in the first direction B1 and the third direction B3. Biasing of the valve shaft 40 and the valve plate 42 in the first direction B1 and the third direction B3 reduces or eliminates relative movement of the valve shaft 40 with respect to the bushing 88 and the second bushing 90, which can reduce wear of the valve shaft 40, the bushing 88, and the second bushing 90.

The valve assembly 30 may further include a sealing assembly 94 disposed within the housing cavity 86. The sealing assembly 94 may limit leakage of fluid from the bore 38 and between the valve shaft 40 and the bushing 88. The sealing assembly 94 may include a sealing washer 96 disposed about the valve shaft 40 and coaxial with the second axis A2. The sealing washer 96 may have various constructions and arrangements, which may depend upon, among other factors, the desired leak-prevention performance. The sealing washer 96 may be an annular washer. When present, the sealing washer 96 is engaged with the bushing 88 such that the bushing 88 is disposed between the sealing washer 96 and the bore 38. The sealing washer 96 may be comprised of a metallic material, such as stainless steal, graphite, or any other suitable material.

The sealing assembly 94 may also include a retaining washer 98 spaced from the sealing washer 96 along the second axis A2 such that the sealing washer 96 is disposed between the retaining washer 98 and the bushing 88. When present, the retaining washer 98 is disposed about the valve shaft 40 and coaxial with the second axis A2. The retaining washer 98 may be rigidly attached to the valve housing 32, such as by staking the retaining washer 98 to the valve housing 32, welding, threading, or any other suitable manner. The retaining washer 98 may be constructed as an annular washer or any other suitable configuration. The retaining washer 98 may be comprised of a metallic material such as stainless steel or cold rolled steel.

The sealing assembly 94 may further include a biasing member 100 disposed between and engaged with the sealing washer 96 and the retaining washer 98. The biasing member 100 may be compressed between the sealing washer 96 and the retaining washer 98. The biasing member 100 may be a wave washer, a helical spring, or any other suitable component. When present, the biasing member 100 forces the sealing washer 96 against the bushing 88 for sealing the housing cavity 86 from the bore 38. As described above, the retaining washer 98 may be rigidly attached to the valve housing 32, which allows the biasing member 100 to force the sealing washer 96 against the bushing 88. For illustrative purposes and for clarity throughout the specification, the sealing assembly 94 may be further defined as a first sealing assembly 94, the sealing washer is further defined as a first sealing washer 96, and the biasing member 100 is further defined as a first biasing member 100.

The valve shaft 40 may have a shaft diameter D4. When present, the first sealing washer 96 has a first inner diameter D5 and the retaining washer 98 has a retaining inner diameter D6, as best shown in FIG. 3. The first inner diameter D5 and the retaining inner diameter D6 may be greater than the shaft diameter D4 for allowing the minimum flow of fluid between the valve shaft 40 and the first sealing washer 96 and the retaining washer 98, and for allowing thermal contraction and expansion of the first sealing washer 96 and the retaining washer 98. Although the first inner diameter D5 and the retaining inner diameter D6 may be greater than the shaft diameter D4 for allowing thermal contraction and expansion, the first inner diameter D5 and the retaining inner diameter D6 may be about 0.030 mm to about 0.050 mm greater than the shaft diameter D4. Alternatively, the first inner diameter D5 and the retaining inner diameter D6 may be about 0.040 mm greater than the shaft diameter D4. It is to be appreciated that the first inner diameter D5 and the retaining inner diameter D6 may be greater than 0.050 mm greater than the shaft diameter D4 or less than 0.030 mm greater than the shaft diameter D4. As such, the flow of fluid between the valve shaft 40 and the first sealing washer 96 and the retaining washer 98 is minimized. In the event that fluid does flow past the first sealing washer 96 and between the valve shaft 40 and the first sealing washer 96 and the retaining washer 98, the valve housing 32 may define a duct 102 extending from the interior surface 36 of the valve housing 32 to the exterior surface 34 of the valve housing 32. The duct 102 allows the flow of fluid between the valve shaft 40 and the first sealing washer 96 and the retaining washer 98 to flow to the duct 102 to maintain atmospheric pressure in the housing cavity 86. The adapter 80 may define the duct 102.

The first sealing washer 96 may define a first outer diameter D7 and the interior surface 36 of the valve housing 32 may define a housing cavity diameter D8, as best shown in FIG. 3. In one embodiment, the housing cavity diameter D8 is greater than the first outer diameter D7 for avoiding contact of the first sealing washer 96 and the valve housing 32 during contact of the valve shaft 40 and the first sealing washer 96. Additionally, when the housing cavity diameter D8 is greater than the first outer diameter D7, thermal contraction and expansion of the first sealing washer 96 is allowed. The housing cavity diameter D8 may be about 0.20 mm to 1.00 mm greater than the first outer diameter D7 to allow for clearance and thermal expansion and contraction of the first sealing washer 96 and housing diameter D8.

When present, the adapter cavity 84 of the adapter 80 may have a first counter bore 104 adjacent the housing cavity 86 and a second counter bore 106 adjacent the first counter bore 104 such that the first counter bore 104 is disposed between the housing cavity 86 and the second counter bore 106. The first counter bore 104 may have a first counter diameter D10 and the second counter bore 106 may have a second counter diameter D9, as best shown in FIG. 3. The valve assembly 30 may also include a second sealing assembly 108 disposed within the adapter cavity 84. The second sealing assembly 108 may be spaced from the first sealing assembly 94. It is to be appreciated that the valve housing 32 may define the adapter cavity 84 and, in turn, the first counter bore 104 and the second counter bore 106, as best shown in FIG. 12, without departing from the nature of the present invention. In other words, in this embodiment, the valve assembly 30 is free of the adapter 80. Further, when the valve housing 32 defines the adapter cavity 84 and when the second sealing assembly 108 is present, the second sealing assembly 108 may be disposed within the adapter cavity 84. When the valve housing 32 defines the adapter cavity 84, the adapter cavity 84 may be referred to as a housing adapter cavity 110, as best shown in FIG. 12. It is also to be appreciated that the valve assembly 30 may include both the first sealing assembly 94 and the second sealing assembly 108, or the valve assembly 30 may only include one of the first sealing assembly 94 and the second sealing assembly 108.

The second sealing assembly 108 may be disposed within the adapter cavity 84. The second sealing assembly 108 may include a seal 112 disposed about the valve shaft 40 and coaxial with the second axis A2, with the seal 112 disposed within the first counter bore 104 and engaged with the adapter 80. The second sealing assembly 108 may include a second sealing washer 114 disposed about the valve shaft 40 and coaxial with the second axis A2, with the second sealing washer 114 disposed within the second counter bore 106 and engaged with the adapter 80. The second sealing assembly 108 may include a third sealing washer 116 disposed about the valve shaft 40 and coaxial with the second axis A2, with the third sealing washer 116 disposed within the second counter bore 106 and engaged with the second sealing washer 114 such that the second sealing washer 114 is disposed between the seal 112 and the third sealing washer 116. The second and third sealing washers 114, 116 may have various constructions and arrangements, which may depend upon the desired leak-prevention performance and other factors. The second and third sealing washers 114, 116 may be an annular washer, and may be comprised of a metallic material, such as stainless steal. The second and third sealing washers 114, 116 may be graphite, or any other suitable material.

The second sealing assembly 108 may include a second biasing member 118 disposed within the second counter bore 106 and engaged with the third sealing washer 116 and the engagement member 46*b*. The second biasing member 118 may be a wave washer, a helical spring, or any other suitable component. When present, the second biasing member 118 may bias the third sealing washer 116 against the second sealing washer 114 in a manner that will force the second sealing washer 114 against the adapter 80 in the second direction B2, which may prevent leakage of fluid between the adapter 80, the second sealing washer 114, and the third sealing washer 116. The second biasing member 118 may bias the engagement member 46*b*, the valve shaft 40, and the valve plate 42 in the first direction B1 such that the valve plate 42 engages the bushing 88, which stops movement of the valve shaft 40 and the engagement member 46*b* in the first direction B1. The biasing of the engagement member 46*b*, the valve shaft 40, and the valve plate 42 in the first direction B1 by the second biasing member 118 helps reduce movement of the valve plate 42 within the bore 38, and movement of the valve shaft 40, which may reduce wear of the valve shaft 40 and the valve plate 42. As the biasing force of the second biasing member 118 increases, the force needed to rotate the valve shaft 40 increases. However, the biasing force of the second biasing member 118 may be decreased due to the at least one non-parallel surface 52 engaging the other of the stop member 46*a* and the engagement member 46*b* and biasing the valve shaft 40 axially along the second axis A2 in the first direction B1.

With reference to FIG. 3, the second sealing washer 114 may have a second inner diameter D11 and the third sealing washer 116 may have a third inner diameter D12. The second and third inner diameters D11, D12 may be greater than the shaft diameter D4 for avoiding contact of the valve shaft 40 and the second and third sealing washers 114, 116 and for allowing thermal expansion and contraction of the second and third sealing washers 114, 116. The second and third inner diameters D11, D12 may be about 0.030 mm to about 0.050 mm greater than the shaft diameter D4. It is to be appreciated that the second and third inner diameters D11, D12 may be greater than 0.050 mm greater than the shaft diameter D4 or less than 0.030 mm greater than the shaft diameter D4. During rotation of the valve shaft 40, binding between the third sealing washer 116 and the second sealing washer 114 may be reduced or eliminated by providing low friction materials for the third sealing washer 116 and the second sealing washer 114 where the third sealing washer 116 and the second sealing washer 114 engage. The low friction material may be graphite, Teflon®, or any other suitable material.

The second sealing washer 114 may have a second outer diameter D13 and the third sealing washer 116 may have a third outer diameter D14. The second and third outer diameters D13, D14 may be less than the second counter diameter D9 for avoiding contact of the second and third sealing washers 114, 116 and the adapter 80 when the valve shaft 40 contacts one of the second and third sealing washers 114, 116 and for allowing thermal expansion and contraction of the second and third sealing washers 114, 116. The second and third outer diameters D13, D14 may be 0.20 mm to 1.00 mm less than the second counter diameter D9 to allow for thermal expansion and contraction of the second and third sealing washers 114, 116.

The seal 112 may have a seal inner diameter D15 and a seal outer diameter D16. The seal inner diameter D15 may be less than the shaft diameter D4 and the seal outer diameter D16 may be greater than the first counter diameter D10 for fixing the seal 112 to the valve shaft 40 within the first counter bore 104. When the seal 112 is non-compressed, i.e., free of external forces, the seal inner diameter D15 of the non-compressed seal 112 is less than the seal inner diameter D15 of the compressed seal 112 when the seal 112 is engaged with the valve shaft 40. Likewise, when the seal 112 is non-compressed, the seal outer diameter D16 of the non-compressed seal 112 is greater than the outer seal diameter D16 of the compressed seal 112 when the seal is within the first counter bore 104. When the seal inner diameter D15 is less than the shaft diameter D4 and the seal outer diameter D16 is greater than the first counter diameter D10, the seal 112 biases against and engages the valve shaft 40 and the adapter 80. Engagement of the seal 112 with the valve shaft 40 and the adapter 80 seals the housing cavity 86 from the adapter cavity 84. Sealing the housing cavity 86 from the adapter cavity 84 prevents debris from entering into the housing cavity 86, which is usually caused by pressure differences between the atmosphere, the adapter cavity 84, and the housing cavity 86. Wear on the valve shaft 40 may allow debris to flow between the valve shaft 40 and the first sealing washer 96, the second sealing washer 114, and the third sealing washer 116, which may be caused by the flow of fluid and pressure differences within the bore 38. Debris entering into the housing cavity 86 and/or the adapter cavity 84 can cause wear and decrease life of the valve assembly 30. The seal 112 may be made of graphite, fluorosilicone, fluorocarbon, polytetrafluoroethylene, such as Teflon®, or any other suitable material.

When present, the adapter 80 helps provides an easier assembly of the first sealing assembly 94 and the second sealing assembly 108. The first sealing assembly 94 is disposed within the housing cavity 86 prior to coupling the adapter 80 to the valve housing 32. The adapter 80 is then coupled to the valve housing 32 and the second sealing assembly 108 is placed within the adapter cavity 84. After the second sealing assembly 108 is placed within the adapter cavity 84, the valve shaft 40 is placed within the bore 38, the housing cavity 86, and the adapter cavity 84, and then attached to the valve plate 42 by the fasteners 44.

As described above, the duct 102 helps to vent fluid leaked from the bore 38 and through the first sealing assembly 94 into the atmosphere. Likewise, the duct 102 may also vent fluid leaked through the second sealing assembly 108 and into the atmosphere.

It is to be appreciated that other sealing assemblies may be used in the valve assembly 30. Examples of other sealing assemblies are disclosed in U.S. Pat. No. 9,238,979, the disclosure of which is hereby incorporated by reference in its entirety.

It is to be appreciated that various components of the valve system 55 and the valve assembly 30 and relative size and measurements shown throughout the Figures are merely illustrative and my not be shown to scale.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A valve assembly for regulating fluid flow in an internal combustion engine, said valve assembly comprising:

a valve housing having an exterior surface and an interior surface which defines a bore, with said bore having a length and a first axis extending along said length, and with said bore having a bore diameter measured radially from said first axis;

a valve shaft partially disposed and extending within said bore along a second axis that is perpendicular to said first axis, with said valve shaft rotatable about said second axis;

a valve plate coupled to said valve shaft and disposed within said bore, with said valve plate moveable upon rotation of said valve shaft between at least a first position for allowing fluid to flow within said bore, and a second position for restricting the flow of fluid within said bore, and with said valve plate having a plate width measured radially from said first axis that is less than said bore diameter thereby allowing axial movement of said valve shaft and said valve plate along said second axis; and a restricting device comprising, a stop member extending from said exterior surface of said valve housing to present a stop surface, and an engagement member extending from said valve shaft, with said engagement member rotatable with said valve shaft and engageable with said stop member, and with said engagement member presenting an engagement surface;

wherein at least one of said stop surface and said engagement surface is non-parallel with said second axis, wherein said at least one non-parallel surface is engageable with the other of said stop member and said engagement member, and wherein said at least one non-parallel surface is configured to bias said valve shaft axially along said second axis in a first direction and is configured to prevent axial movement of said valve shaft and said valve plate along said second axis in a second direction different from said first direction during engagement of said at least one non-parallel surface and the other of said stop member and said engagement member.

2. The valve assembly as set forth in claim 1, wherein said stop surface is non-parallel with said second axis.

3. The valve assembly as set forth in claim 2, wherein said stop surface is angled with respect to said second axis and engageable with said engagement member, and wherein said angled stop surface is engaged by said engagement member and biases said valve shaft axially along said second axis in a first direction for preventing axial movement of said valve shaft and said valve plate along said second axis in a second direction opposite said first direction.

4. The valve assembly as set forth in claim 3, wherein said engagement surface is angled with respect to said second axis, and wherein said angled stop surface biases against said angled engagement surface to bias said valve shaft axially along said second axis in said first direction for preventing axial movement of said valve shaft and said valve plate along said second axis in said second direction.

5. The valve assembly as set forth in claim 4, wherein said angled stop surface and said angled engagement surface are parallel to one another.

6. The valve assembly as set forth in claim 2, wherein said stop surface is curved with respect to said second axis and engageable with said engagement member, and wherein said curved stop surface is engaged by said engagement member and biases said valve shaft axially along said second axis in a first direction for preventing axial movement of said valve shaft and said valve plate along said second axis in a second direction opposite said first direction.

7. The valve assembly as set forth in claim 1, wherein said engagement surface is non-parallel with said second axis.

8. The valve assembly as set forth in claim 7, wherein said engagement surface is angled with respect to said second axis and engageable with said stop member, and wherein said angled engagement surface engages said stop member and biases said valve shaft axially along said second axis in a first direction for preventing axial movement of said valve shaft and said valve plate along said second axis in a second direction opposite said first direction.

9. The valve assembly as set forth in claim 7, wherein said engagement surface is curved with respect to said second axis and engageable with said stop member, and wherein said curved engagement surface engages said stop member and biases said valve shaft axially along said second axis in said first direction for preventing axial movement of said valve shaft and said valve plate along said second axis in said second direction.

10. The valve assembly as set forth in claim 9, wherein said stop surface is curved with respect to said second axis, and wherein said curved stop surface biases against said curved engagement surface to bias said valve shaft axially along said second axis in said first direction for preventing axial movement of said valve shaft and said valve plate along said second axis in said second direction.

11. The valve assembly as set forth in claim 1, wherein said stop surface is non-parallel with said second axis and said engagement surface is non-parallel with said second axis.

12. The valve assembly as set forth in claim 1, wherein said valve plate is in said first position when said at least one non-parallel surface is engaged with the other of said stop member and said engagement member.

13. The valve assembly as set forth in claim 12, wherein said valve plate is substantially parallel to said first axis when in said first position.

14. The valve assembly as set forth in claim 1, wherein said valve plate is in said second position when said at least one non-parallel surface is engaged with the other of said stop member and said engagement member.

15. The valve assembly as set forth in claim 1, wherein said engagement member is integral with said valve shaft.

16. The valve assembly as set forth in claim 1, wherein said stop member is integral with said valve housing.

17. The valve assembly as set forth in claim 1, wherein said non-parallel surface and said second axis define an angle from about 1 degree to about 35 degrees.

18. The valve assembly as set forth in claim 17, wherein said angle is from about 5 to about 30 degrees.

19. The valve assembly as set forth in claim 1, further comprising an adapter adjacent said valve housing and having an interior adapter surface defining an adapter cavity about said second axis, with a portion of said valve shaft disposed within said adapter cavity, wherein said stop member is integral with said adapter.

20. The valve assembly as set forth in claim 1, wherein said interior surface of said valve housing defines a housing cavity about said second axis adjacent said bore, and further comprising a bushing disposed within said housing cavity, with said bushing coaxial with said second axis and disposed about said valve shaft for supporting said valve shaft during rotation and during engagement of said at least one non-parallel surface and the other of said stop member and said engagement member, and with said non-parallel surface biasing said valve shaft radially from said second axis in a third direction different from said first and second directions into said bushing for further preventing axial movement of said valve shaft and said valve plate along said second axis in said second direction and for preventing radial movement of said valve shaft and said valve plate with respect to said second axis.

21. The valve assembly as set forth in claim 20, further comprising a first sealing assembly disposed within said housing cavity, said first sealing assembly comprising, a sealing washer disposed about said valve shaft and coaxial with said second axis, with said sealing washer engaged with said bushing such that said bushing is disposed between said sealing washer and said bore, a retaining washer spaced from said sealing washer along said second axis such that said sealing washer is disposed between said retaining washer and said bore, with said retaining washer disposed about said valve shaft and coaxial with said second axis, and a biasing member disposed between and engaged with said sealing washer and said retaining washer, with said biasing member compressing said sealing washer against said bushing for sealing said housing cavity from said bore.

22. The valve assembly as set forth in claim 21, further comprising an adapter adjacent said valve housing and having an interior adapter surface defining an adapter cavity about said second axis, with said adapter cavity having a first counter bore adjacent said housing cavity and a second counter bore adjacent said first counter bore such that said first counter bore is disposed between said housing cavity and said second counter bore, with said first counter bore having a first counter diameter and said second counter bore having a second counter diameter, and with said sealing washer further defined as a first sealing washer, and said biasing member further defined as a first biasing member; and a second sealing assembly disposed within said adapter cavity, said second sealing assembly comprising, a seal disposed about said valve shaft and coaxial with said second axis, with said seal disposed within said first counter bore and engaged with said adapter, a second sealing washer disposed about said valve shaft and coaxial with said second axis, with said second sealing washer disposed within said second counter bore and engaged with said adapter, a third sealing washer disposed about said valve shaft and coaxial with said second axis, with said third sealing washer disposed within said second counter bore and engaged with said second sealing washer such that said second sealing washer is disposed between said seal and said third sealing washer, and a second biasing member disposed within said second counter bore and engaged with said third sealing washer and said engagement member, with said second biasing member biasing said third sealing washer against said second sealing washer to bias said second sealing washer against said adapter in said second direction, and with said second biasing member biasing said engagement member and said valve shaft in said first direction such that said valve plate engages said bushing and stops movement of said valve shaft and said engagement member in said first direction.

23. A valve system for regulating fluid flow in an internal combustion engine, said valve system comprising:

a valve housing having an exterior surface and an interior surface which defines a bore, with said bore having a length and a first axis extending along said length, and with said bore having a diameter measured radially from said first axis;

an actuator coupled to said valve housing;

a valve shaft partially disposed and extending within said bore along a second axis that is perpendicular to said first axis, with said valve shaft rotatable about said second axis by said actuator;

a valve plate coupled to said valve shaft and disposed within said bore, with said valve plate moveable upon rotation of said valve shaft between at least a first position for allowing fluid to flow within said bore, and a second position for restricting the fluid to flow within said bore, and with said valve plate having a plate width measured radially from said first axis that is less than said bore diameter thereby allowing axial movement of said valve shaft and said valve plate along said second axis; and a restricting device comprising, a stop member extending from said exterior surface of said valve housing to present a stop surface, and an engagement member extending from said valve shaft, with said engagement member rotatable with said valve shaft and engageable with said stop member, and with said engagement member presenting an engagement surface;

wherein at least one of said stop surface and said engagement surface is non-parallel with said second axis, wherein said at least one non-parallel surface is engageable with the other of said stop member and said engagement member, and wherein said at least one non-parallel surface is configured to bias said valve shaft axially along said second axis in a first direction and is configured to prevent axial movement of said valve shaft and said valve plate along said second axis in a second direction different from said first direction during engagement of said at least one non-parallel surface and the other of said stop member and said engagement member.

* * * * *